US007482113B2

(12) United States Patent
Simpson et al.

(10) Patent No.: US 7,482,113 B2
(45) **Date of Patent: *Jan. 27, 2009**

(54) PHOTOTHERMOGRAPHIC MATERIALS CONTAINING CO-DEVELOPERS WITH PHOSPHONIUM CATION

(75) Inventors: Sharon M. Simpson, Lake Elmo, MN (US); Kumars Sakizadeh, Woodbury, MN (US)

(73) Assignee: Carestream Health, Inc., Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/611,914

(22) Filed: Dec. 18, 2006

(65) Prior Publication Data

US 2008/0145788 A1 Jun. 19, 2008

(51) Int. Cl.
*G03C 5/16* (2006.01)
*G03C 1/498* (2006.01)

(52) U.S. Cl. ..... 430/350; 430/598; 430/610; 430/619

(58) Field of Classification Search ..... 430/350, 430/619, 598, 610, 486
See application file for complete search history.

(56) References Cited

U.S. PATENT DOCUMENTS 4,211,839 A * 7/1980 Suzuki et al. ..... 430/619
5,545,515 A 8/1996 Murray et al.
5,635,339 A 6/1997 Murray
5,968,725 A 10/1999 Katoh et al.
6,090,538 A 7/2000 Arai et al.
6,120,983 A * 9/2000 Okada et al. ..... 430/619
6,331,386 B1 12/2001 Ezoe et al.
6,413,712 B1 7/2002 Yoshioka et al.
6,645,714 B2 11/2003 Oya et al.
6,746,835 B2 * 6/2004 Watanabe et al. ..... 430/619

FOREIGN PATENT DOCUMENTS

EP 1096310 A2 * 5/2001
JP 2004-125997 9/2002
JP 2003-114497 4/2003
JP 2003-121964 4/2003
JP 2005-208476 4/2005
JP 2005-338660 12/2005
JP 2006-133818 2/2006

OTHER PUBLICATIONS

U.S. Appl. No. 11/611,913, filed Dec. 18, 2006 titled *Photothermographic Materials Containing Developer and Co-Developer* by Chaofeng Zou et al.

* cited by examiner

*Primary Examiner*—Thorl Chea

(57) ABSTRACT

Incorporating a combination of a trisphenol reducing agent (developer) and a substituted olefinic co-developer having a phosphonium cation in photothermographic materials improves image tone in resulting images.

20 Claims, No Drawings

PHOTOTHERMOGRAPHIC MATERIALS CONTAINING CO-DEVELOPERS WITH PHOSPHONIUM CATION

FIELD OF THE INVENTION

This invention relates to black-and-white photothermographic materials having a combination of a trisphenol reducing agent and an olefinic co-developer containing a phosphonium cation that provides improved image tone after development. This invention also relates to methods of imaging and using these materials.

BACKGROUND OF THE INVENTION

Silver-containing direct thermographic and photothermographic imaging materials (that is, thermally developable imaging materials) that are imaged and/or developed using heat and without liquid processing have been known in the art for many years.

Silver-containing direct thermographic imaging materials are non-photo-sensitive materials that are used in a recording process wherein images are generated by the direct application of thermal energy and in the absence of a processing solvent. These materials generally comprise a support having disposed thereon (a) a relatively or completely non-photosensitive source of reducible silver ions, (b) a reducing composition (acting as a black-and-white silver developer) for the reducible silver ions, and (c) a suitable binder. Thermographic materials are sometimes called "direct thermal" materials in the art because they are directly imaged by a source of thermal energy without any transfer of the image or image-forming materials to another element (such as in thermal dye transfer).

In a typical thermographic construction, the image-forming thermographic layers comprise non-photosensitive reducible silver salts of long chain fatty acids. A preferred non-photosensitive reducible silver source is a silver salt of a long chain aliphatic carboxylic acid having from 10 to 30 carbon atoms, such as behenic acid or mixtures of acids of similar molecular weight. At elevated temperatures, the silver of the silver carboxylate is reduced by a reducing agent for silver ion (also known as a developer), whereby elemental silver is formed. Preferred reducing agents include methyl gallate, hydroquinone, substituted-hydroquinones, hindered phenols, catechols, pyrogallol, ascorbic acid, and ascorbic acid derivatives.

Some thermographic constructions are imaged by contacting them with the thermal head of a thermographic recording apparatus such as a thermal print-head of a thermal printer or thermal facsimile. In such constructions, an anti-stick layer is coated on top of the imaging layer to prevent sticking of the thermographic construction to the thermal head of the apparatus utilized. The resulting thermographic construction is then heated imagewise to an elevated temperature, typically in the range of from about 60 to about 225° C., resulting in the formation of a black-and-white image of silver.

Silver-containing photothermographic imaging materials (that is, photosensitive thermally developable imaging materials) that are imaged with actinic radiation and then developed using heat and without liquid processing, have also been known in the art for many years. Such materials are used in a recording process wherein an image is formed by imagewise exposure of the photothermographic material to specific electromagnetic radiation (for example, X-radiation, or ultraviolet, visible, or infrared radiation) and developed by the use of thermal energy. These materials, also known as "dry silver" materials, generally comprise a support having coated thereon: (a) a photocatalyst (that is, a photosensitive compound such as silver halide) that upon such exposure provides a latent image in exposed grains that are capable of acting as a catalyst for the subsequent formation of a silver image in a development step, (b) a relatively or completely non-photosensitive source of reducible silver ions, (c) a reducing composition (acting as a developer) for the reducible silver ions, and (d) a binder. The latent image is then developed by application of thermal energy.

In photothermographic materials, exposure of the photosensitive silver halide to light produces small clusters containing silver atoms $(Ag^0)_n$. The imagewise distribution of these clusters, known in the art as a latent image, is generally not visible by ordinary means. Thus, the photosensitive material must be further developed to produce a visible image. This is accomplished by the reduction of silver ions that are in catalytic proximity to silver halide grains bearing the silver-containing clusters of the latent image. This produces a black-and-white image. The non-photosensitive silver source is catalytically reduced to form the visible black-and-white negative image of silver while much of the silver halide, generally, remains as silver halide and is not reduced.

In photothermographic materials, the reducing agent for the reducible silver ions, often referred to as a "developer", may be any compound that, in the presence of the latent image, can reduce silver ion to metallic silver and is preferably of relatively low activity until it is heated to a temperature sufficient to cause the reaction. A wide variety of classes of compounds have been disclosed in the literature that function as reducing agents for photo-thermographic materials. Upon heating, and at elevated temperatures, the reducible silver ions are reduced by the reducing agent. This reaction occurs preferentially in the regions surrounding the latent image and produces a negative image of metallic silver having a color that ranges from yellow to deep black depending upon the presence of toning agents and other components in the photothermographic imaging layer(s).

Differences Between Photothermography and Photography

The imaging arts have long recognized that the field of photothermography is clearly distinct from that of photography. Photothermographic materials differ significantly from conventional silver halide photographic materials that require processing with aqueous processing solutions.

In photothermographic imaging materials, a visible image is created in the absence of a processing solvent by heat as a result of the reaction of a reducing agent incorporated within the material. Heating at 50° C. or more is essential for this dry development. In contrast, conventional photographic imaging materials require processing in aqueous processing baths at more moderate temperatures (from 30° C. to 50° C.) to provide a visible image.

In photothermographic materials, only a small amount of silver halide is used to capture light and a non-photosensitive source of reducible silver ions (for example, a silver carboxylate or a silver benzotriazole) is used to generate the visible image using thermal development. Thus, the imaged photosensitive silver halide serves as a catalyst for the physical development process involving the non-photosensitive source of reducible silver ions and the incorporated reducing agent. In contrast, conventional wet-processed, black-and-white photographic materials use only one form of silver (that is, silver halide) that, upon chemical development, is itself at least partially converted into the silver image, or that upon physical development requires addition of an external silver source (or other reducible metal ions that form black images upon reduction to the corresponding metal). Thus, photothermographic materials require an amount of silver halide per unit area that is only a fraction of that used in conventional wet-processed photographic materials.

In photothermographic materials, all of the "chemistry" for imaging is incorporated within the material itself. For example, such materials include a reducing agent (that is, a developer for the reducible silver ions) while conventional photographic materials usually do not. The incorporation of the reducing agent into photothermographic materials can lead to increased formation of various types of "fog" or other undesirable sensitometric side effects. Therefore, much effort has gone into the preparation and manufacture of photothermographic materials to minimize these problems.

Moreover, in photothermographic materials, the unexposed silver halide generally remains intact after development and the material must be stabilized against further imaging and development. In contrast, silver halide is removed from conventional photographic materials after solution development to prevent further imaging (that is in the aqueous fixing step).

Because photothermographic materials require dry thermal processing, they present distinctly different problems and require different materials in manufacture and use, compared to conventional, wet-processed silver halide photographic materials. Additives that have one effect in conventional silver halide photographic materials may behave quite differently when incorporated in photothermographic materials where the underlying chemistry is significantly more complex. The incorporation of such additives as, for example, stabilizers, antifoggants, speed enhancers, supersensitizers, and spectral and chemical sensitizers in conventional photographic materials is not predictive of whether such additives will prove beneficial or detrimental in photothermographic materials. For example, it is not uncommon for a photographic antifoggant useful in conventional photographic materials to cause various types of fog when incorporated into photothermographic materials, or for supersensitizers that are effective in photographic materials to be inactive in photothermographic materials.

These and other distinctions between photothermographic and photographic materials are described in *Unconventional Imaging Processes*, E. Brinckman et al. (Eds.), The Focal Press, London and New York, 1978, pp. 74-75, in D. H. Klosterboer, *Imaging Processes and Materials*, (*Neblette's Eighth Edition*), J. Sturge, V. Walworth, and A. Shepp, Eds., Van Nostrand-Reinhold, New York, 1989, Chapter 9, pp. 279-291, in C. Zou et al., *J. Imaging Sci. Technol.* 1996, 40, pp. 94-103, and in M. R. V. Sahyun, *J. Imaging Sci. Technol.* 1998, 42, 23.

Problem to be Solved

Photothermographic materials are commercially available for use in the medical imaging industry, and are particularly used for diagnosis and archival of clinical images. One of the most important aspects of such photothermographic materials is their ability to record and communicate diagnostically significant image information.

Radiologists often characterize diagnostic capability of photothermographic imaging materials with terms like sharpness, clarity, resolution, contrast, graininess, and crispness. However, it has been found that image tone can play a significant role in how easily diagnostic information can be read from an image. Often, altering nothing but the tone of a photothermographic imaging material can enhance or reduce the apparent sharpness and clarity in the resulting image.

Tone can be defined as the color of the image with respect to all densities. Tint can be defined as the color of the image in the unexposed background areas (Dmin).

U.S. Pat. No. 6,413,712 (Yoshioka et al.), U.S. Pat. No. 5,968,725 (Katoh), U.S. Pat. No. 6,090,538 (Arai), and U.S. Pat. No. 6,645,714 (Oya) describe various binary mixtures of bisphenols with monophenols or trisphenols with monophenols as reducing agents (developers) in photothermographic materials.

Nucleating agents or co-developers have been described in the art for use in photothermographic materials to provide unique properties such as ultra high image contrast, higher development reactivity, or higher silver efficiency. For example, substituted olefinic co-developers such as acrylonitrile co-developers are described in U.S. Pat. No. 5,545,515 (Murray et al.) and U.S. Pat. No. 5,635,339 (Murray). Other useful acrylonitrile co-developers have a crown ether-alkali metal complex cation and an enolate anion of an aldehyde with at least one electron withdrawing group in the α-position.

While olefinic co-developers have been widely used in the production of high contrast printing plates, due to the reactive nature of many such nucleating agents, it has been difficult to use them for practical applications in commercial products that require the contrast of the sensitometric D vs. log E curve to be less than 5 to provide images with continuous tone (that is, to give an adequate gray scale range necessary for medical diagnostic purposes). The sensitometric properties of photothermographic materials containing known co-developers as development accelerators or as silver efficiency enhancing agents generally fluctuate in high humidity conditions during coating, storage, imaging, and processing.

Japanese Published Applications (Kokai) 2005-338660 (Goto), 2005-208476 (Ishidai et al.), 2003-121964 (Sakata et al.), and 2003-114497 (Yasukawa et al.) describe photothermographic materials containing onium salts of nucleating agents and that are used for preparing high contrast printing plates.

In copending and commonly assigned U.S. Ser. No. 11/611,913 (filed by Zou, Vang, Lynch, Ramsden, Simpson, and Sakizadeh on even date herewith, Attorney Docket 92951/JLT), and entitled "Photothermographic Materials Containing Developer and Co-Developer", improvements in processing latitude and reduced sensitivity to high humidity in photothermo graphic materials was achieved by using certain substituted olefinic co-developers with certain trisphenol developers (reducing agents).

Despite the improvements provided by the materials described and claimed in the noted co-filed application, there is an additional need for photothermographic materials that provide images with improved image tone. These materials are especially needed for the medical imaging industry.

SUMMARY OF THE INVENTION

To address this need, this invention provides a photothermographic material comprising a support having on at least one side thereof, one or more photothermographic imaging layers comprising in reactive association:

a. a photosensitive silver halide,
b. a non-photosensitive source of reducible silver ions,
c. a reducing agent composition for the reducible silver ions comprising a trisphenol reducing agent represented by the following Structure (I),
d. a polymeric binder, and
e. a substituted olefinic co-developer that is represented by the following Structure (IV):

Structure (I)

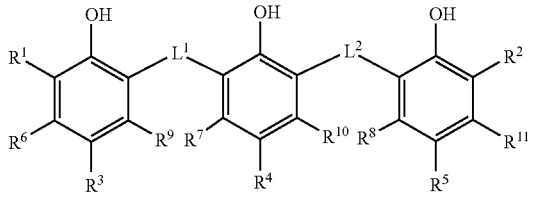

wherein $L^1$ and $L^2$ are independently sulfur or a mono-substituted or unsubstituted methylene group, $R^1$ and $R^2$ are independently primary or secondary substituted or unsubstituted alkyl groups having 1 to 12 carbon atoms, $R^3$, $R^4$, and $R^5$ are independently substituted or unsubstituted alkyl groups having 1 to 12 carbon atoms, substituted or unsubstituted alkoxy groups having 1 to 12 carbon atoms, or halo groups, and $R^6$, $R^7$, $R^8$, $R^9$, $R^{10}$, and $R^{11}$ are independently hydrogen or any substituent that is substitutable on a benzene ring, (IV)

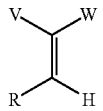

wherein V and W are independently aromatic or electron withdrawing groups, provided that at least one of V and W is an electron withdrawing group, or V and W can represent the atoms necessary to form a ring containing an electron withdrawing group, R is an $—O^-A^+$ or $—S^-A^+$ group, and $A^+$ is a quaternary phosphonium cation.

This invention further provides a method of forming a visible image comprising:

(A) imagewise exposing a photothermographic material of this invention to electromagnetic radiation to form a latent image, (B) simultaneously or sequentially, heating the exposed photothermographic material to develop the latent image into a visible image.

We have found that by incorporating specific combinations of a trisphenol reducing agent and a substituted olefinic co-developer having a phosphonium cation in photothermographic materials, improved image tone is achieved with little change in other sensitometric properties. This advantage is provided by the use of the phosphonium cation in the co-developer compared to alkali metal, quaternary ammonium, or tertiary sulfonium cations. This image tone improvement is demonstrated below in the Examples wherein preferable bluer image tones are identified with more positive numbers as calculated by the difference of the blue filter density from the visible density when scanned at a peak transmission of about 440 nm.

DETAILED DESCRIPTION OF THE INVENTION

The photothermographic materials of this invention are used to provide black-and-white or color images using appropriate imaging chemistry and particularly non-photosensitive organic silver salts, photosensitive silver halides, reducing agents, toners, binders, and other components known to a skilled artisan. The reducing agent and phosphonium salt combinations described herein are present in reactive association with the photosensitive silver halide and non-photosensitive silver salt.

The photothermographic materials can be used in black-and-white or color photothermography and in electronically generated black-and-white or color hardcopy recording. They can be used in microfilm applications, in radiographic imaging (for example digital medical imaging), X-ray radiography, and in industrial radiography. Furthermore, the absorbance of these materials between 350 and 450 nm is desirably low (less than 0.5), to permit their use in the graphic arts area (for example, image-setting and phototype-setting), in the manufacture of printing plates, in contact printing, in duplicating ("duping"), and in proofing. Black-and-white imaging is particularly preferred.

The photothermographic materials are particularly useful for imaging of human or animal subjects in response to, X-radiation, ultraviolet, visible, or infrared radiation for use in a medical diagnosis. Such applications include, but are not limited to, thoracic imaging, mammography, dental imaging, orthopedic imaging, general medical radiography, therapeutic radiography, veterinary radiography, and autoradiography. When used with X-radiation, the photothermographic materials may be used in combination with one or more phosphor intensifying screens, with phosphors incorporated within the photothermographic emulsion, or with combinations thereof. Such materials are particularly useful for dental radiography when they are directly imaged by X-radiation. The materials are also useful for non-medical uses of X-radiation such as X-ray lithography and industrial radiography.

The photothermographic materials can be made sensitive to radiation of any suitable wavelength. Thus, in some embodiments, the materials are sensitive at ultraviolet, visible, infrared, or near infrared wavelengths, of the electromagnetic spectrum. In preferred embodiments, the materials are sensitive to radiation greater than 600 nm (and preferably sensitive to infrared radiation from about 700 up to about 950 nm). Increased sensitivity to a particular region of the spectrum is imparted through the use of various spectral sensitizing dyes.

In the photothermographic materials, the components needed for imaging can be in one or more photothermographic imaging layers on one side ("frontside") of the support. The layer(s) that contain the photosensitive photocatalyst (such as a photosensitive silver halide) or non-photosensitive source of reducible silver ions, or both, are referred to herein as photothermographic emulsion layer(s). The photocatalyst and the non-photosensitive source of reducible silver ions are in catalytic proximity and preferably are in the same emulsion layer.

Where the photothermographic materials contain imaging layers on one side of the support only, various non-imaging layers are usually disposed on the "backside" (non-emulsion or non-imaging side) of the materials, including conductive/antistatic layers, antihalation layers, protective layers, and transport enabling layers.

Various non-imaging layers can also be disposed on the "frontside" or imaging or emulsion side of the support, including protective frontside overcoat layers, primer layers, interlayers, opacifying layers, conductive/antistatic layers, antihalation layers, acutance layers, auxiliary layers, and other layers readily apparent to one skilled in the art.

For some embodiments, it may be useful that the photothermographic materials be "double-sided" or "duplitized"

and have the same or different photo-thermographic coatings (or imaging layers) on both sides of the support. In such constructions each side can also include one or more protective overcoat layers, primer layers, interlayers, acutance layers, conductive/antistatic layers auxiliary layers, anti-crossover layers, and other layers readily apparent to one skilled in the art, as well as the required conductive layer(s).

When the photothermographic materials are heat-developed as described below in a substantially water-free condition after, or simultaneously with, imagewise exposure, a silver image (preferably a black-and-white silver image) is obtained.

Definitions

As used herein:

In the descriptions of the photothermographic materials, "a" or "an" component refers to "at least one" of that component [for example, the reducing agents (developers), substituted olefinic co-developers with phosphonium cations described herein].

As used herein, "black-and-white" preferably refers to an image formed by silver metal, as opposed to an image formed using a combination of dyes or color couplers.

Unless otherwise indicated, when the term "photothermographic materials" is used herein, the term refers to embodiments of the present invention.

Heating in a substantially water-free condition as used herein, means heating at a temperature of from about 50° C. to about 250° C. with little more than ambient water vapor present. The term "substantially water-free condition" means that the reaction system is approximately in equilibrium with water in the air and water or any other solvent for inducing or promoting the reaction is not particularly or positively supplied from the exterior to the material. Such a condition is described in T. H. James, *The Theory of the Photographic Process*, Fourth Edition, Eastman Kodak Company, Rochester, N.Y., 1977, p. 374.

"Photothermographic material(s)" means a dry processable integral element comprising a support and at least one photothermographic emulsion layer or a photothermographic set of emulsion layers (wherein the photosensitive silver halide and the source of reducible silver ions are in one layer and the other necessary components or additives are distributed, as desired, in the same layer or in an adjacent coated layer). These materials also include multilayer constructions in which one or more imaging components are in different layers, but are in "reactive association". For example, one layer can include the non-photosensitive source of reducible silver ions and another layer can include the reducing and substituted olefinic co-developer, but the two reactive components are in reactive association with each other. By "integral", we mean that all imaging chemistry required for imaging is in the material without diffusion of imaging chemistry or reaction products (such as a dye) from or to another element (such as a receiver element).

When used in photothermography, the term, "imagewise exposing" or "imagewise exposure" means that the material is imaged as a dry processable material using any exposure means that provides a latent image using electromagnetic radiation. This includes, for example, by analog exposure where an image is formed by projection onto the photosensitive material as well as by digital exposure where the image is formed one pixel at a time such as by modulation of scanning laser radiation.

The term "emulsion layer", "imaging layer", or "photothermographic emulsion layer" means a layer of a photothermographic material that contains the photosensitive silver halide (when used) and/or non-photosensitive source of reducible silver ions, or a reducing agent composition. Such layers can also contain additional components or desirable additives. These layers are on what is referred to as the "frontside" of the support.

"Photocatalyst" means a photosensitive compound such as silver halide that, upon exposure to radiation, provides a compound that is capable of acting as a catalyst for the subsequent development of the image-forming material.

"Catalytic proximity" or "reactive association" means that the reactive components are in the same layer or in adjacent layers so that they readily come into contact with each other during imaging and thermal development.

The terms "reducing agent" and "developer" mean the same, and the terms "co-reducing agent" and "co-developer" also mean the same.

"Simultaneous coating" or "wet-on-wet" coating means that when multiple layers are coated, subsequent layers are coated onto the initially coated layer before the initially coated layer is dry. Simultaneous coating can be used to apply layers on the frontside, backside, or both sides of the support.

"Transparent" means capable of transmitting visible light or imaging radiation without appreciable scattering or absorption.

The phrases "silver salt" and "organic silver salt" refer to an organic molecule having a bond to a silver atom. Although the compounds so formed are technically silver coordination complexes or silver compounds they are also often referred to as silver salts.

The phrase "aryl group" refers to an organic group derived from an aromatic hydrocarbon or heterocyclic compound by removal of one atom, such as a phenyl group formed by removal of one hydrogen atom from benzene. Thus "aromatic" and "aryl" are meant to include both carbocyclic and heterocyclic aromatic groups.

"Silver Efficiency" is defined as $D_{max}$ divided by the total silver coating weight in units of $g/m^2$.

The term "buried layer" means that there is at least one other layer disposed over the layer (such as a "buried" backside conductive layer).

The terms "coating weight", "coat weight", and "coverage" are synonymous, and are usually expressed in weight or moles per unit area such as $g/m^2$ or $mol/m^2$.

"Ultraviolet region of the spectrum" refers to that region of the spectrum less than or equal to 400 nm (preferably from about 100 nm to about 400 nm) although parts of these ranges may be visible to the naked human eye.

"Visible region of the spectrum" refers to that region of the spectrum of from about 400 nm to about 700 nm.

"Short wavelength visible region of the spectrum" refers to that region of the spectrum of from about 400 nm to about 450 nm.

"Red region of the spectrum" refers to that region of the spectrum of from about 600 nm to about 700 nm.

"Infrared region of the spectrum" refers to that region of the spectrum of from about 700 nm to about 1400 nm.

"Non-photosensitive" means not intentionally light sensitive.

The sensitometric terms "photospeed", "speed", or "photographic speed" (also known as sensitivity), absorbance, and contrast have conventional definitions known in the imaging arts. The sensitometric term absorbance is another term for optical density (OD).

Speed-2 is Log1/E+4 corresponding to the density value of 1.0 above $D_{min}$ where E is the exposure in $ergs/cm^2$.

Average Contrast-1 ("AC-1") is the absolute value of the slope of the line joining the density points at 0.60 and 2.00 above $D_{min}$.

In photothermographic materials, the term $D_{min}$ (lower case) is considered herein as image density achieved when the photothermographic material is thermally developed without prior exposure to radiation. The term $D_{max}$ (lower case) is the maximum image density achieved in the imaged area of a particular sample after imaging and development.

The term $D_{MIN}$ (upper case) is the density of the nonimaged, undeveloped material. The term $D_{MAX}$ (upper case) is the maximum image density achievable when the photothermographic material is exposed and then thermally developed. $D_{MAX}$ is also known as "Saturation Density".

As is well understood in this art, for the chemical compounds herein described, substitution is not only tolerated, but is often advisable and various substituents are anticipated on the compounds used in the present invention unless otherwise stated. Thus, when a compound is referred to as "having the structure" of a given formula or being a "derivative" of a compound, any substitution that does not alter the bond structure of the formula or the shown atoms within that structure is included within the formula, unless such substitution is specifically excluded by language.

As a means of simplifying the discussion and recitation of certain substituent groups, the term "group" refers to chemical species that may be substituted as well as those that are not so substituted. Thus, the term "alkyl group" is intended to include not only pure hydrocarbon alkyl chains, such as methyl, ethyl, n-propyl, t-butyl, cyclohexyl, iso-octyl, and octadecyl, but also alkyl chains bearing substituents known in the art, such as hydroxyl, alkoxy, phenyl, halogen atoms (F, Cl, Br, and I), cyano, nitro, amino, and carboxy. For example, alkyl group includes ether and thioether groups (for example $CH_3$—$CH_2$—$CH_2$—O—$CH_2$— and $CH_3$—$CH_2$—$CH_2$—S—$CH_2$—), haloalkyl, nitroalkyl, alkylcarboxy, carboxyalkyl, carboxamido, hydroxyalkyl, sulfoalkyl, and other groups readily apparent to one skilled in the art. Substituents that adversely react with other active ingredients, such as very strongly electrophilic or oxidizing substituents, would, of course, be excluded by the skilled artisan as not being inert or harmless.

*Research Disclosure* (http://www.researchdisclosure.com) is a publication of Kenneth Mason Publications Ltd., The Book Barn, Westbourne, Hampshire PO10 8RS, UK. It is also available from Emsworth Design Inc., 200 Park Avenue South, Room 1101, New York, N.Y. 10003.

Other aspects, advantages, and benefits of the present invention are apparent from the detailed description, examples, and claims provided in this application.

The Photocatalyst

As noted above, photothermographic materials include one or more photocatalysts in the photothermographic emulsion layer(s). Useful photocatalysts are typically photosensitive silver halides such as silver bromide, silver iodide, silver chloride, silver bromoiodide, silver chlorobromoiodide, silver chlorobromide, and others readily apparent to one skilled in the art. Mixtures of silver halides can also be used in any suitable proportion. Silver bromide and silver iodide are preferred. More preferred is silver bromoiodide in which any suitable amount of iodide is present up to almost 100% silver iodide and more likely up to about 40 mol % silver iodide. Even more preferably, the silver bromoiodide comprises at least 70 mole % (preferably at least 85 mole % and more preferably at least 90 mole %) bromide (based on total silver halide). The remainder of the halide is iodide, chloride, or chloride and iodide. Preferably the additional halide is iodide. Silver bromide and silver bromoiodide are most preferred, with the latter silver halide generally having up to 10 mole % silver iodide.

In some embodiments of aqueous-based photothermographic materials, higher amounts of iodide may be present in homogeneous photosensitive silver halide grains, and particularly from about 20 mol % up to the saturation limit of iodide as described, for example, U.S. patent application Publication 2004/0053173 (Maskasky et al.).

The silver halide grains may have any crystalline habit or morphology including, but not limited to, cubic, octahedral, tetrahedral, orthorhombic, rhombic, dodecahedral, other polyhedral, tabular, laminar, twinned, or platelet morphologies and may have epitaxial growth of crystals thereon. If desired, a mixture of grains with different morphologies can be employed. Silver halide grains having cubic and tabular morphology (or both) are preferred.

The silver halide grains may have a uniform ratio of halide throughout. They may also have a graded halide content, with a continuously varying ratio of, for example, silver bromide and silver iodide or they may be of the core-shell type, having a discrete core of one or more silver halides, and a discrete shell of one or more different silver halides. Core-shell silver halide grains useful in photothermographic materials and methods of preparing these materials are described in U.S. Pat. No. 5,382,504 (Shor et al.). Iridium and/or copper doped core-shell and non-core-shell grains are described in U.S. Pat. No. 5,434,043 (Zou et al.) and U.S. Pat. No. 5,939,249 (Zou). Bismuth(III)-doped high silver iodide emulsions for aqueous-based photothermographic materials are described in U.S. Pat. No. 6,942,960 (Maskasky et al.).

In some instances, it may be helpful to prepare the photosensitive silver halide grains in the presence of a hydroxytetraazaindene (such as 4-hydroxy-6-methyl-1,3,3a,7-tetraazaindene) or an N-heterocyclic compound comprising at least one mercapto group (such as 1-phenyl-5-mercaptotetrazole) as described in U.S. Pat. No. 6,413,710 (Shor et al.).

The photosensitive silver halide can be added to (or formed within) the emulsion layer(s) in any fashion as long as it is placed in catalytic proximity to the non-photosensitive source of reducible silver ions.

It is preferred that the silver halides be preformed and prepared by an ex-situ process. With this technique, one has the possibility of more precisely controlling the grain size, grain size distribution, dopant levels, and composition of the silver halide, so that one can impart more specific properties to both the silver halide grains and the resulting photothermographic material.

In some constructions, it is preferable to form the non-photosensitive source of reducible silver ions in the presence of ex-situ-prepared silver halide. In this process, the source of reducible silver ions, such as a long chain fatty acid silver carboxylate (commonly referred to as a silver "soap" or homogenate), is formed in the presence of the preformed silver halide grains. Co-precipitation of the source of reducible silver ions in the presence of silver halide provides a more intimate mixture of the two materials to provide a material often referred to as a "preformed soap" [see U.S. Pat. No. 3,839,049 (Simons)].

In some constructions, it is preferred that preformed silver halide grains be added to and "physically mixed" with the non-photosensitive source of reducible silver ions.

Preformed silver halide emulsions can be prepared by aqueous or organic processes and can be unwashed or washed to remove soluble salts. Soluble salts can be removed by any desired procedure for example as described in U.S. Pat. No.

2,489,341 (Waller et al.), U.S. Pat. No. 2,565,418 (Yackel), U.S. Pat. No. 2,614,928 (Yutzy et al.), U.S. Pat. No. 2,618,556 (Hewitson et al.), and U.S. Pat. No. 3,241,969 (Hart et al.).

It is also effective to use an in-situ process in which a halide- or a halogen-containing compound is added to an organic silver salt to partially convert the silver of the organic silver salt to silver halide. Inorganic halides (such as zinc bromide, zinc iodide, calcium bromide, lithium bromide, lithium iodide, or mixtures thereof) or an organic halogen-containing compound (such as N-bromosuccinimide or pyridinium hydrobromide perbromide) can be used. The details of such in-situ generation of silver halide are described in U.S. Pat. No. 3,457,075 (Morgan et al.).

It is particularly effective to use a mixture of both preformed and in-situ generated silver halide. The preformed silver halide is preferably present in a preformed soap.

Additional methods of preparing silver halides and organic silver salts and blending them are described in *Research Disclosure*, June 1978, item 17029, U.S. Pat. No. 3,700,458 (Lindholm) and U.S. Pat. No. 4,076,539 (Ikenoue et al.), and Japan Kokai 49-013224 (Fuji), 50-017216 (Fuji), and 51-042529 (Fuji).

The silver halide grains used in the imaging formulations can vary in average diameter of up to several micrometers (μm) depending on the desired use. Preferred silver halide grains for use in preformed emulsions containing silver carboxylates are cubic grains having a number average particle size of from about 0.01 to about 1.0 μm, more preferred are those having a number average particle size of from about 0.03 to about 0.1 μm. It is even more preferred that the grains have a number average particle size of 0.06 μm or less, and most preferred that they have a number average particle size of from about 0.03 to about 0.06 μm. Mixtures of grains of various average particle size can also be used. Preferred silver halide grains for high-speed photothermographic constructions use are tabular grains having an average thickness of at least 0.02 μm and up to and including 0.10 μm, an equivalent circular diameter of at least 0.5 μm and up to and including 8 μm and an aspect ratio of at least 5:1. More preferred are those having an average thickness of at least 0.03 μm and up to and including 0.08 μm, an equivalent circular diameter of at least 0.75 μm and up to and including 6 μm and an aspect ratio of at least 10:1.

The average size of the photosensitive silver halide grains is expressed by the average diameter if the grains are spherical, and by the average of the diameters of equivalent circles for the projected images if the grains are cubic or in other non-spherical shapes. Representative grain sizing methods are described in *Particle Size Analysis*, ASTM Symposium on Light Microscopy, R. P. Loveland, 1955, pp. 94-122, and in C. E. K. Mees and T. H. James, *The Theory of the Photographic Process*, Third Edition, Macmillan, New York, 1966, Chapter 2. Particle size measurements may be expressed in terms of the projected areas of grains or approximations of their diameters. These will provide reasonably accurate results if the grains of interest are substantially uniform in shape.

The one or more light-sensitive silver halides are preferably present in an amount of from about 0.005 to about 0.5 mole, more preferably from about 0.01 to about 0.25 mole, and most preferably from about 0.03 to about 0.15 mole, per mole of non-photosensitive source of reducible silver ions.

Chemical Sensitization

The photosensitive silver halides can be chemically sensitized using any useful compound that contains sulfur, tellurium, or selenium, or may comprise a compound containing gold, platinum, palladium, ruthenium, rhodium, iridium, or combinations thereof, a reducing agent such as a tin halide or a combination of any of these. The details of these materials are provided for example, in T. H. James, *The Theory of the Photographic Process*, Fourth Edition, Eastman Kodak Company, Rochester, N.Y., 1977, Chapter 5, pp. 149-169. Suitable conventional chemical sensitization procedures are also described in U.S. Pat. No. 1,623,499 (Sheppard et al.), U.S. Pat. No. 2,399,083 (Waller et al.), U.S. Pat. No. 3,297,446 (Dunn), U.S. Pat. No. 3,297,447 (McVeigh), U.S. Pat. No. 5,049,485 (Deaton), U.S. Pat. No. 5,252,455 (Deaton), U.S. Pat. No. 5,391,727 (Deaton), U.S. Pat. No. 5,759,761 (Lushington et al.), and U.S. Pat. No. 5,912,111 (Lok et al.), and EP 0 915 371A1 (Lok et al.).

Mercaptotetrazoles and tetraazindenes as described in U.S. Pat. No. 5,691,127 (Daubendiek et al.) can also be used as suitable addenda for tabular silver halide grains. Certain substituted and unsubstituted thiourea compounds can be used as chemical sensitizers including those described in U.S. Pat. No. 6,368,779 (Lynch et al.). Still other additional chemical sensitizers include certain tellurium-containing compounds that are described in U.S. Pat. No. 6,699,647 (Lynch et al.), and certain selenium-containing compounds that are described in U.S. Pat. No. 6,620,577 (Lynch et al.). Combinations of gold(III)-containing compounds and either sulfur-, tellurium-, or selenium-containing compounds are also useful as chemical sensitizers as described in U.S. Pat. No. 6,423,481 (Simpson et al.). In addition, sulfur-containing compounds can be decomposed on silver halide grains in an oxidizing environment according to the teaching in U.S. Pat. No. 5,891,615 (Winslow et al.). Examples of sulfur-containing compounds that can be used in this fashion include sulfur-containing spectral sensitizing dyes. Other useful sulfur-containing chemical sensitizing compounds that can be decomposed in an oxidizing environment are the diphenylphosphine sulfide compounds described in U.S. Pat. No. 7,026,105 (Simpson et al.) and U.S. Pat. No. 7,063,941 (Burleva et al.), and in U.S. Patent Application Publication 2005/0123871 (Burleva et al.).

The chemical sensitizers can be present in conventional amounts that generally depend upon the average size of the silver halide grains. Generally, the total amount is at least $10^{-10}$ mole per mole of total silver, and preferably from about $10^{-8}$ to about $10^{-2}$ mole per mole of total silver for silver halide grains having an average size of from about 0.01 to about 1 μm.

Spectral Sensitization

The photosensitive silver halides may be spectrally sensitized with one or more spectral sensitizing dyes that are known to enhance silver halide sensitivity to ultraviolet, visible, and/or infrared radiation (that is, sensitivity within the range of from about 300 to about 1400 nm). It is preferred that the photosensitive silver halide be sensitized to infrared radiation (that is from about 700 to about 950 nm). Non-limiting examples of spectral sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. They may be added at any stage in the preparation of the photothermographic emulsion, but are generally added after chemical sensitization is achieved.

Suitable spectral sensitizing dyes such as those described in U.S. Pat. No. 3,719,495 (Lea), U.S. Pat. No. 4,396,712 (Kinoshita et al.), U.S. Pat. No. 4,439,520 (Kofron et al.), U.S. Pat. No. 4,690,883 (Kubodera et al.), U.S. Pat. No. 4,840,882 (Iwagaki et al.), U.S. Pat. No. 5,064,753 (Kohno et al.), U.S. Pat. No. 5,281,515 (Delprato et al.), U.S. Pat. No. 5,393,654

(Burrows et al.), U.S. Pat. No. 5,441,866 (Miller et al.), U.S. Pat. No. 5,508,162 (Dankosh), U.S. Pat. No. 5,510,236 (Dankosh), and U.S. Pat. No. 5,541,054 (Miller et al.), Japan Kokai 2000-063690 (Tanaka et al.), 2000-112054 (Fukusaka et al.), 2000-273329 (Tanaka et al.), 2001-005145 (Arai), 2001-064527 (Oshiyama et al.), and 2001-154305 (Kita et al.) can be used. Useful spectral sensitizing dyes are also described in *Research Disclosure*, December 1989, item 308119, Section IV and *Research Disclosure,* 1994, item 36544, section V Specific combinations of spectral sensitizing dyes are shown in U.S. Pat. No. 4,581,329 (Sugimoto et al.), U.S. Pat. No. 4,582,786 (Ikeda et al.), U.S. Pat. No. 4,609,621 (Sugimoto et al.), U.S. Pat. No. 4,675,279 (Shuto et al.), U.S. Pat. No. 4,678,741 (Yamada et al.), U.S. Pat. No. 4,720,451 (Shuto et al.), U.S. Pat. No. 4,818,675 (Miyasaka et al.), U.S. Pat. No. 4,945,036 (Arai et al.), and U.S. Pat. No. 4,952,491 (Nishikawa et al.).

Also useful are spectral sensitizing dyes that decolorize by the action of light or heat as described in U.S. Pat. No. 4,524,128 (Edwards et al.) and Japanese Kokai 2001-109101 (Adachi), 2001-154305 (Kita et al.), and 2001-183770 (Hanyu et al.).

Dyes and other compounds may be selected for the purpose of supersensitization to attain much higher sensitivity than the sum of sensitivities that can be achieved by using a sensitizer alone. Examples of such supersensitizers include the metal chelating compounds disclosed in U.S. Pat. No. 4,873,184 (Simpson), the large cyclic compounds featuring a heteroatom disclosed in U.S. Pat. No. 6,475,710 (Kudo et al.), the stilbene compounds disclosed in EP 0 821 271 (Uytterhoeven et al.).

An appropriate amount of spectral sensitizing dye added is generally about $10^{-10}$ to $10^{-1}$ mole, and preferably, about $10^{-7}$ to $10^{-2}$ mole per mole of silver halide.

Non-Photosensitive Source of Reducible Silver Ions

The non-photosensitive source of reducible silver ions in the thermally developable materials is a silver-organic compound that contains reducible silver(I) ions. Such compounds are generally silver salts of silver organic coordinating ligands that are comparatively stable to light and form a silver image when heated to 50° C. or higher in the presence of an exposed photocatalyst (such as silver halide, when used in a photothermographic material) and a reducing agent composition.

The primary organic silver salt is often a silver salt of an aliphatic carboxylic acid (described below). Mixtures of silver salts of aliphatic carboxylic acids are particularly useful where the mixture includes at least silver behenate.

Useful silver carboxylates include silver salts of long-chain aliphatic carboxylic acids. The aliphatic carboxylic acids generally have aliphatic chains that contain 10 to 30, and preferably 15 to 28, carbon atoms. Examples of such preferred silver salts include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. Most preferably, at least silver behenate is used alone or in mixtures with other silver carboxylates.

Silver salts other than the silver carboxylates described above can be used also. Such silver salts include silver salts of aliphatic carboxylic acids containing a thioether group as described in U.S. Pat. No. 3,330,663 (Weyde et al.), soluble silver carboxylates comprising hydrocarbon chains incorporating ether or thioether linkages or sterically hindered substitution in the α-(on a hydrocarbon group) or ortho- (on an phenyl group) position as described in U.S. Pat. No. 5,491,059 (Whitcomb), silver salts of dicarboxylic acids, silver salts of sulfonates as described in U.S. Pat. No. 4,504,575 (Lee), silver salts of sulfosuccinates as described in EP 0 227 141A1 (Leenders et al.), silver salts of aryl carboxylic acids (such as silver benzoate), silver salts of acetylenes as described, for example in U.S. Pat. No. 4,761,361 (Ozaki et al.) and U.S. Pat. No. 4,775,613 (Hirai et al.), and silver salts of heterocyclic compounds containing mercapto or thione groups and derivatives as described in U.S. Pat. No. 4,123,274 (Knight et al.) and U.S. Pat. No. 3,785,830 (Sullivan et al.).

It is also convenient to use silver half soaps such as an equimolar blend of silver carboxylate and carboxylic acid that analyzes for about 14.5% by weight solids of silver in the blend and that is prepared by precipitation from an aqueous solution of an ammonium or an alkali metal salt of a commercially available fatty carboxylic acid, or by addition of the free fatty acid to the silver soap.

The methods used for making silver soap emulsions are well known in the art and are disclosed in *Research Disclosure,* April 1983, item 22812, *Research Disclosure*, October 1983, item 23419, U.S. Pat. No. 3,985,565 (Gabrielsen et al.) and the references cited above.

Sources of non-photosensitive reducible silver ions can also be core-shell silver salts as described in U.S. Pat. No. 6,355,408 (Whitcomb et al.), silver dimer compounds that comprise two different silver salts as described in U.S. Pat. No. 6,472,131 (Whitcomb), or the silver core-shell compounds comprising a primary core comprising one or more photosensitive silver halides, or one or more non-photo-sensitive inorganic metal salts or non-silver containing organic salts, and a shell at least partially covering the primary core, wherein the shell comprises one or more non-photosensitive silver salts, each of which silver salts comprises a organic silver coordinating ligand, as described in U.S. Pat. No. 6,803,177 (Bokhonov et al.).

Organic silver salts that are particularly useful in aqueous based thermographic and photothermographic materials include silver salts of compounds containing an imino group. Preferred examples of these compounds include, but are not limited to, silver salts of benzotriazole and substituted derivatives thereof (for example, silver methylbenzotriazole and silver 5-chlorobenzotriazole), silver salts of 1,2,4-triazoles or 1-H-tetrazoles such as phenylmercaptotetrazole as described in U.S. Pat. No. 4,220,709 (deMauriac), and silver salts of imidazoles and imidazole derivatives as described in U.S. Pat. No. 4,260,677 (Winslow et al.). Particularly useful silver salts of this type are the silver salts of benzotriazole and substituted derivatives thereof. A silver salt of a benzotriazole is particularly preferred in aqueous-based thermographic and photothermographic formulations.

Useful nitrogen-containing organic silver salts and methods of preparing them are described in U.S. Pat. No. 6,977,139 (Hasberg et al.). Such silver salts (particularly the silver benzotriazoles) are rod-like in shape and have an average aspect ratio of at least 3:1 and a width index for particle diameter of 1.25 or less. Silver salt particle length is generally less than 1 μm. Also useful are silver salt-toner co-precipitated nano-crystals as described in U.S. Pat. No. 7,008,748 (Hasberg et al.).

The one or more non-photosensitive sources of reducible silver ions are preferably present in an amount of from about 5% to about 70%, and more preferably from about 10% to about 50%, based on the total dry weight of the emulsion layers. Alternatively stated, the amount of the sources of reducible silver ions is generally from about 0.002 to about 0.2 mol/m$^2$ of the dry photothermographic material (preferably from about 0.01 to about 0.05 mol/m$^2$).

The total amount of silver (from all silver sources) in the photothermographic materials is generally at least 0.002 mol/m$^2$, preferably from about 0.01 to about 0.05 mol/m$^2$, and more preferably from about 0.01 to about 0.02 mol/m$^2$. In other aspects, it is desirable to use total silver [from both silver halide (when present) and reducible silver salts] at a coating weight of less than 2.6 g/m$^2$, preferably at least 1 but less than 1.9 g/m$^2$.

Reducing Agent

The reducing agent composition comprises at least one trisphenol reducing agent represented by the following Structure (I):

Structure (I)

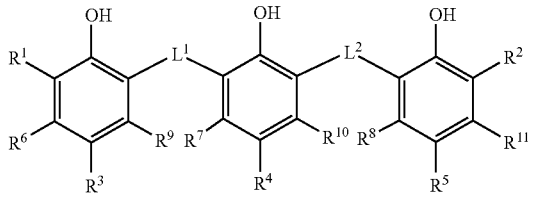

wherein $L^1$, $L^2$, and $L^3$ are independently sulfur or mono-substituted or unsubstituted methylene groups, $R^1$ and $R^2$ are independently primary or secondary substituted or unsubstituted alkyl groups having 1 to 12 carbon atoms that can be linear, branched or cyclic (such as methyl, ethyl, n-propyl, iso-propyl, iso-butyl, cyclohexyl, benzyl, 4-methylcyclohexyl, norbornyl, or isobornyl), $R^3$, $R^4$, and $R^5$ are independently substituted or unsubstituted alkyl groups having 1 to 12 carbon atoms (such as methyl, ethyl, n-propyl, iso-propyl, iso-butyl, tert-butyl, cyclohexyl, benzyl, 4-methylcyclohexyl, norbornyl, or isobornyl), substituted or unsubstituted alkoxy groups having 1 to 12 carbon atoms (such as methoxy, ethoxy, propoxy, iso-propoxy, or n-butoxy), or halo groups (such as chloro or bromo), and $R^6$, $R^7$, $R^8$, $R^9$, $R^{10}$, and $R^{11}$ are independently hydrogen or any substituent that is substitutable on a benzene ring.

Preferably, $L^1$ and $L^2$ are independently methylene groups or mono-substituted methylene groups (for example, a mono-substituted methylene group substituted with one alkyl group, aryl group, cycloalkyl group, or heterocyclic group), $R^1$ and $R^2$ are independently substituted or unsubstituted primary or secondary alkyl groups having 1 to 8 carbon atoms, $R^3$, $R^4$, and $R^5$ are independently substituted or unsubstituted alkyl groups having 1 to 6 carbon atoms, and $R^6$, $R^7$, $R^8$, $R^9$, $R^{10}$, and $R^{11}$ are independently hydrogen, or substituted or unsubstituted methyl, ethyl, or methoxy groups, or chloro groups.

More preferably, $L^1$ and $L^2$ are unsubstituted methylene groups, $R^1$ and $R^2$ are the same substituted or unsubstituted primary or secondary alkyl groups having 1 to 6 carbon atoms, $R^3$, $R^4$, and $R^5$ are the same substituted or unsubstituted methyl or ethyl groups, and $R^6$, $R^7$, $R^8$, $R^9$, $R^{10}$, and $R^{11}$ are independently hydrogen or unsubstituted methyl groups.

Compounds (I-1) to (I-18) in TABLE I are representative of the trisphenol reducing agents represented by Structure (I) (wherein $R^6$, $R^7$, $R^8$, $R^9$, $R^{10}$ and $R^{11}$ are each hydrogen) that are useful in the present invention. Of these listed compounds, Compounds I-2 and I-3 of TABLE I are most preferred.

TABLE I

| Compound | $R_1$, $R_2$ | $R_3$, $R_5$ | $R_4$ | $L^1$, $L^2$ |
|---|---|---|---|---|
| I-1 | $CH_3$ | t-$C_4H_9$ | $CH_3$ | $CH_2$ |
| I-2 | $CH_3$ | $CH_3$ | $CH_3$ | $CH_2$ |
| I-3 | Cyclo-hexyl | $CH_3$ | $CH_3$ | $CH_2$ |
| I-4 | Isobornyl | $CH_3$ | $CH_3$ | $CH_2$ |
| I-5 | $CH_3$ | $CH_3$ | $CH_3$ | $CH(C_3H_7)$ |
| I-6 | $C_2H_5$ | $CH_3$ | $CH_3$ | $CH_2$ |
| I-7 | $CH_3$ | $C_2H_5$ | $CH_3$ | $CH_2$ |
| I-8 | $CH_3$ | $CH_3$ | t-$C_4H_9$ | $CH_2$ |
| I-9 | $CH_3$ | $CH_3$ | $C_2H_5$ | $CH_2$ |
| I-10 | $CH_3$ | $CH_3$ | $OCH_3$ | $CH_2$ |
| I-11 | $CH_3$ | $CH_3$ | Cl | $CH_2$ |
| I-12 | Norbornyl | $CH_3$ | $CH_3$ | $CH_2$ |
| I-13 | $CH_3$ | $CH_3$ | $CH_3$ | $CH(CH_2CH_2C_6H_5)$ |
| I-14 | i-($C_3H_7$) | $CH_3$ | $CH_3$ | $CH_2$ |
| I-15 | Cyclo-pentyl | $CH_3$ | $CH_3$ | $CH_2$ |
| I-16 | $CH_3$ | $CH_2CH_2OH$ | $CH_3$ | $CH_2$ |
| I-17 | $CH_3$ | $CH_3$ | $CH_3$ | $CH(CH_2CH_2CH_2OH)$ |
| I-18 | $CH_3$ | $CH_3$ | Cyclo-hexyl | $CH_2$ |

The various trisphenols represented by Structure I can be obtained from a number of commercial sources, including Aldrich Chemical Company (Milwaukee, Wis.), or they can be prepared using known synthetic methods, for example, the procedures described in D. J. Beaver et al., *J. Amer Chem Soc.,* 1953, 75, 5579-81.

The trisphenol reducing agents represented by the compounds of Structure (I) generally provide from about 1 to about 45% (dry weight), and preferably from about 1 to about 20%, of the emulsion layer in which it is located. In multilayer constructions, if the reducing agent(s) is added to a layer other than an emulsion layer, slightly higher proportions, of from about 2 to 55 weight % may be more desirable. Thus, the total range for the total amount of phenolic reducing agents can be from about 1 to about 55% (dry weight). Also, these phenolic reducing agents are generally present in an amount of at least 0.05 and up to and including about 0.5 mol/mol of total silver in the photothermographic material, or at least 0.05 mmol/m$^2$, and preferably in an amount of from about 0.1 to about 0.4 mol/mol of total silver, or from about 1 to about 5 mmol/m$^2$. Other additional reducing agents (described below) that may be present could contribute additional amounts of overall reducing agents to the imaging chemistry. However, the trisphenols of Structure (I) are the "predominant" reducing agents in the photothermographic materials, which means that they comprise at least 50 mol % and preferably at least 70 mol % of the total reducing agents (developers) in the photothermographic materials.

In preferred embodiments, a reducing agent of Structure (I) is used in combination with one or more monophenol reducing agents represented by Structure (II) below, or one or more bisphenol reducing agents represented by Structure (III) below, or one or more of both of the monophenol or bisphenol reducing agents. In most preferred embodiments, at least one bisphenol reducing agent is present.

Structure (II)

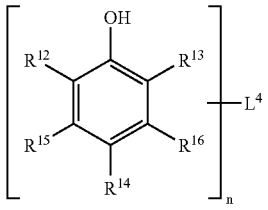

Structure (III)

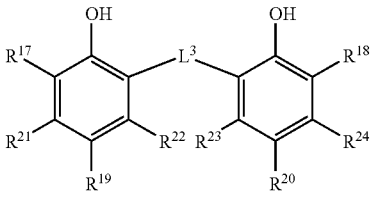

wherein $L^3$ is sulfur or a mono-substituted or unsubstituted methylene group, $R^{19}$ and $R^{20}$ are independently substituted or unsubstituted alkyl groups having 1 to 12 carbon atoms (such as methyl, ethyl, n-propyl, iso-propyl, iso-butyl, tert-butyl, cyclohexyl, benzyl, 4-methylcyclohexyl, norbornyl, or isobornyl), substituted or unsubstituted alkoxy groups having 1 to 12 carbon atoms (such as methoxy, ethoxy, propoxy, iso-propoxy, or n-butoxy), or halo groups (such as chloro or bromo), $R^{21}$, $R^{22}$, $R^{23}$, and $R^{24}$ are independently hydrogen or any substituent that is substitutable on a benzene ring, $R^{12}$ and $R^{13}$ are independently substituted or unsubstituted alkyl groups having 1 to 12 carbon atoms exclusive of 2-hydroxyphenylmethyl group, (such as methyl, ethyl, n-propyl, iso-propyl, iso-butyl, tert-butyl, 1-methylcyclohexyl, cyclohexyl, benzyl, tert-pentyl, norbornyl, or isobornyl), substituted or unsubstituted alkoxy groups having 1 to 12 carbon atoms (as defined above), halo groups (such as chloro or bromo), or hydrogen, such that both $R^{12}$ and $R^{13}$ are not both simultaneously hydrogen, $R^{14}$, $R^{15}$, and $R^{16}$ are independently hydrogen, or any substituent that is substitutable on a benzene ring, $R^{17}$ and $R^{18}$ are independently substituted or unsubstituted alkyl groups having 1 to 12 carbon atoms (as defined above for $R^{12}$ and $R^{13}$), n is an integer of 1 or greater, and when n is 2 or greater, $L^4$ is a single bond or a linking group that is attached to any of $R^{12}$, $R^{13}$, $R^{14}$, $R^{15}$, or $R^{16}$.

Preferably, $L^3$ is a methylene group or mono-substituted methylene group (for example, a mono-substituted methylene group substituted with one alkyl group, aryl group, cycloalkyl group, or heterocyclic group), $R^{19}$ and $R^{20}$ are independently substituted or unsubstituted alkyl groups having 1 to 6 carbon atoms, $R^{15}$, $R^{16}$, $R^{21}$, $R^{22}$, $R^{23}$, and $R^{24}$ are independently hydrogen, or substituted or unsubstituted methyl, ethyl, or methoxy groups, or chloro groups, $R^{12}$, $R^{13}$, $R^{17}$, and $R^{18}$ are independently substituted or unsubstituted primary, secondary, or tertiary alkyl groups having 1 to 7 carbon atoms, and $R^{14}$ is a substituted or unsubstituted alkyl group having 1 to 4 carbon atoms, and n is 1 to 4, provided that when n is 2 or greater, $L^4$ is a single bond or a linking group that is attached to any of $R^{14}$, $R^{15}$, $R^{16}$.

More preferably, $L^3$ is an unsubstituted methylene group, $R^{19}$ and $R^{20}$ are the same substituted or unsubstituted methyl or ethyl groups, $R^{15}$, $R^{16}$, $R^{21}$, $R^{22}$, $R^{23}$, and $R^{24}$ are independently hydrogen or unsubstituted methyl groups, $R^{12}$, $R^{13}$, $R^{17}$, and $R^{18}$ are independently substituted or unsubstituted secondary or tertiary alkyl groups having 3 to 7 carbon atoms, and $R^{14}$ is a substituted or unsubstituted alkyl group having 1 to 4 carbon atoms, or in some embodiments, $R^{14}$ is a group represented by $—CH_2CH_2(C{=}O)—$ and $L^4$ is a group represented by $—(OCH_2)_4C—$, particularly when n is 4.

One skilled in the art would understand that when n is 1, $L^4$ is not present.

Compounds (II-1) to (II-17) in TABLE II below are representative of the monophenol reducing agents represented by Structure (II). Compounds (III-1) to (III-18) in TABLE III below are representative of the bisphenol reducing agents represented by Structure (III) (wherein $R^{21}$, $R^{22}$, $R^{23}$, and $R^{24}$ are each hydrogen). Compounds I-2 and I-3 of TABLE I, Compounds II-8 and II-17 of TABLE II, and Compounds III-1 and III-4 of TABLE III, are preferred.

Preferred combinations of reducing agents useful in this invention include combinations of either or both of Compounds I-2 and I-3 of TABLE I with either or both of Compounds II-8 and II-17 of TABLE II. Other preferred combinations include combinations of either or both of Compounds I-2 and I-3 of TABLE I with either or both of Compounds III-1 and III-4 of TABLE III. Still other preferred combinations include combinations of either or both of Compounds I-2 and I-3 of TABLE I with either or both of Compounds II-8 and II-17 of TABLE II and either or both of Compounds III-1 and III-4 of TABLE III.

TABLE II

| Compound | $R^{12}$, $R^{13}$ | $R^{14}$ | $R^{15}$, $R^{16}$ | $L^4$ | n |
|---|---|---|---|---|---|
| II-1 | t-$C_4H_9$ | $CH_3$ | H | Nil | 1 |
| II-2 | t-$C_4H_9$ | t-$C_4H_9$ | H | Nil | 1 |
| II-3 | t-$C_4H_9$, $CH_3$ | $CH_3$ | H | Nil | 1 |
| II-4 | t-$C_4H_9$ | $COOCH_3$ | H | Nil | 1 |
| II-5 | t-$C_4H_9$ | $COOC_{18}H_{37}$ | H | Nil | 1 |
| II-6 | t-$C_5H_{11}$ | $CH_3$ | H | Nil | 1 |
| II-7 | t-$C_4H_9$ | $C_9H_{19}$ | H | Nil | 1 |
| II-8 | t-$C_4H_9$ | $CH_2CH_2(C{=}O)—$ | H | $(—OCH_2)_4C$ | 4 |
| II-9 | t-$C_4H_9$ | $CH_2CH_2(C{=}O)—$ | H | 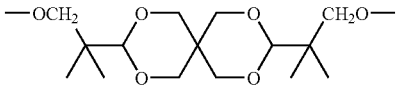 | 2 |
| II-10 | t-$C_4H_9$ | $CH_2—$ | H | single bond | 2 |
| II-11 | t-$C_4H_9$ | $CH_2CH_2(C{=}O)—$ | H | $—OCH_2CH_2O—$ | 2 |

TABLE II-continued

| Compound | $R^{12}$, $R^{13}$ | $R^{14}$ | $R^{15}$, $R^{16}$ | $L^4$ | n |
|---|---|---|---|---|---|
| II-11 | t-$C_4H_9$ | $CH_2CH_2(C{=}O)$— | H | $(—OCH_2)_3CCH_2CH_3$ | 3 |
| II-12 | t-$C_4H_9$ | $CH_2CH_2O$— | H | 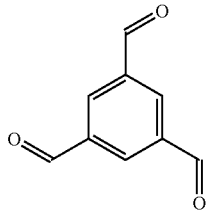 | 3 |
| II-13 | t-$C_4H_9$ | $CH_2CH_2(C{=}O)$— | H | 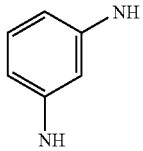 | 2 |
| II-14 | t-$C_4H_9$ | $CH_2CH_2$— | H | single bond | 2 |
| II-15 | t-$C_4H_9$ | $CH_2$— | H | 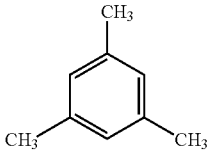 | 3 |
| II-16 | t-$C_4H_9$ | $CH_2CH_2(C{=}O)$— | H | $OCH_2CH_2$—S—$CH_2CH_2O$ | 2 |
| II-17 | t-$C_4H_9$, $CH_3$ | $CH_3$ | $CH_2$—, H | 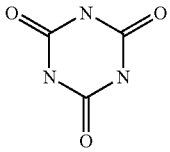 | 3 |

TABLE III

| Compound | $R_{17}$, $R_{18}$ | $R_{19}$, $R_{20}$ | $L^3$ |
|---|---|---|---|
| III-1 | t-$C_4H_9$ | $CH_3$ | $CH_2$ |
| III-2 | $CH_3$ | $CH_3$ | $CH(CH_2CH_2C_6H_5)$ |
| III-3 | $CH_3$ | $CH_3$ | CH(Cyclohexyl) |
| III-4 | 1-$CH_3$(Cyclohexyl) | $CH_3$ | $CH_2$ |
| III-5 | Isobornyl | $CH_3$ | $CH_2$ |
| III-6 | Norbornyl | $CH_3$ | $CH_2$ |
| III-7 | $CH_3$ | $CH_3$ | CH(i-$C_3H_7$) |
| III-8 | $CH_3$ | $C_2H_5$ | $CH_2$ |
| III-9 | t-$C_4H_9$ | $CH_3$ | S |
| III-10 | t-$C_5H_{11}$ | $CH_3$ | $CH_2$ |
| III-11 | Cyclohexyl | $CH_3$ | $CH_2$ |
| III-12 | t-$C_4H_9$ | $CH_2CH_2OH$ | $CH_2$ |
| III-13 | t-$C_4H_9$ | $CH_3$ | $CH(CH_2CH_2CH_2OH)$ |
| III-14 | t-$C_4H_9$ | $CH_3$ | $CH(CH_2CH_2CH_3)$ |
| III-15 | t-$C_4H_9$ | t-$C_4H_9$ | $CHCH_3$ |
| III-16 | $CH_3$ | $CH_2OCH_3$ | $CH(CH_2CH_2CH_3)$ |
| III-17 | $CH_3$ | $CH_3$ | $CH_2(C_3H_7)$ |
| III-18 | $CH_3$ | $CH_3$ | $CH(CH_2CH(CH_3)CH_2C(CH_3)_3)$ |

The various phenols represented by Structures (II) and (III) can be obtained from a number of commercial sources, including Aldrich Chemical Company (Milwaukee, Wis.), or they can be prepared using known synthetic methods. For example, the trisphenols represented by Structure (I) can be prepared by the procedures described in D. J. Beaver et al., *J. Amer Chem Soc.,* 1953, 75, 5579-81.

Still other optional reducing agents include the bisphenol-phosphorous compounds described in U.S. Pat. No. 6,514,684 (Suzuki et al), the bisphenol, aromatic carboxylic acid, hydrogen bonding compound mixture described in U.S. Pat. No. 6,787,298 (Yoshioka), and the compounds that can be one-electron oxidized to provide a one-electron oxidation product that releases one or more electrons as described in U.S. Patent Application Publication 2005/0214702 (Ohzeki). Still other useful reducing agents are described in U.S. Pat. No. 3,074,809 (Owen), U.S. Pat. No. 3,080,254 (Grant, Jr.), U.S. Pat. No. 3,094,417 (Workman), U.S. Pat. No. 3,887,417 (Klein et al.), U.S. Pat. No. 4,030,931 (Noguchi et al.), and U.S. Pat. No. 5,981,151 (Leenders et al.).

Additional reducing agents that may be used along with the trisphenols described above, include amidoximes, azines, ascorbic acid, a reductone, piperidino-hexose reductone, hydroxamic acids, a combination of azines and sulfonamidophenols, α-cyanophenylacetic acid derivatives, reductones, indane-1,3-diones, chromans, 1,4-dihydropyridines, and 3-pyrazolidones.

Co-Developers

The photothermographic materials contain one or more substituted olefinic co-developers each of which has a phosphonium cation. These compounds are organic compounds that by themselves do not act as effective reducing agents (or developers) for the non-photosensitive silver salt, but when used in combination with a trisphenol reducing agent provide, upon development, increased silver development and improved image tone.

These substituted olefinic co-developers can be represented by the following Structure (IV):

(IV)

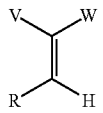

wherein V and W are independently an aromatic groups or electron withdrawing groups, provided that at least one of V and W is an electron withdrawing group, or V and W can represent the atoms necessary to form a ring containing an electron withdrawing group. By "electron withdrawing group", we mean is determined by its Hammett $\sigma_p$ value as defined by the Hammett Equation $\log K/K^o=\sigma_p\rho$ wherein $K^o$ is the acid dissociation constant of the reference in aqueous solution at 25° C., K is the corresponding constant for the para-substituted acid, and ρ is defined as 1.0 for the dissociation of para-substituted benzoic acids. A positive Hammett sigma value indicates that the substituted (or group) is electron withdrawing.

Preferred electron withdrawing groups are those that have a Hammett $\sigma_p$ value greater than 0.2 and more preferably greater than 0.35. Representative electron withdrawing groups include but are not limited to, cyano, halogens, formyl, alkoxycarbonyl groups (or carboalkyoxy groups), metaloxycarbonyl groups, hydroxycarbonyl groups, nitro, acetyl, perfluoroalkyl groups, alkylsulfonyl groups, arylsulfonyl groups as well as other groups listed in Lange's *Handbook of Chemistry,* 14$^{th}$ Ed., McGraw-Hill, 1992, Chapter 9, pp. 2-7. Cyano is the most preferred electron withdrawing group.

The "aromatic groups" for V and W include any carbocyclic or heterocyclic aromatic single or multiple ring group, with or without substitution, including but not limited to, substituted or unsubstituted phenyl, naphthyl, tolyl, pyridyl, furyl, thienyl, benzotriazolyl, benzothiazolyl, and benzimidazolyl groups. Substituted or unsubstituted phenyl groups are preferred, and phenyl groups substituted with electron withdrawing groups, such as halogen-substituted phenyl groups, are particularly useful.

It is particularly useful that V is a carboalkoxy group having 2 to 20 carbon atoms (preferably 2 to 13 carbon atoms and more preferably 2 to 9 carbon atoms), a carboxamido group having 2 to 20 carbon atoms (preferably 2 to 13 carbon atoms and more preferably 2 to 7 carbon atoms), or a substituted or unsubstituted carbocyclic or heterocyclic aryl group having 6 to 10 carbon atoms or heteroatoms in the ring, and W is a cyano group.

In Structure (IV), R is an $—O^-A^+$ or $—S^-A^+$ group and preferably, R is an $—O^-A^+$ group.

$A^+$ is a quaternary phosphonium cation having 16 to 60 carbon atoms. In particular, such cations can be represented by either of the following Structures (V) and (VI):

(V)

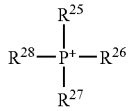

(VI)

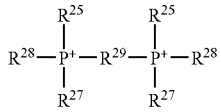

wherein $R^{25}$ through $R^{28}$ are independently alkyl groups having 1 to 12 carbon atoms [including linear, branched and cyclic (cycloalkyl) groups] that can be unsubstituted or substituted with one or more phenyl (to form benzyl groups), ethylbenzyl, propylbenzyl, or butylbenzyl groups. Preferably, these alkyl groups have 1 to 4 carbon atoms and are unsubstituted or substituted with phenyl groups.

$R^{25}$ through $R^{28}$ can also be independently substituted or unsubstituted aryl groups having 6 or 10 atoms in the aromatic ring, and substituents can include phenyl, 1-naphthyl, and 2-naphthyl groups. These aryl groups can be carbocyclic or heterocyclic, but preferably, these aryl groups are carbocyclic aryl groups such as substituted or unsubstituted phenyl groups.

In preferred embodiments, $R^{25}$ through $R^{28}$ are the same or different substituted or unsubstituted phenyl groups, or at least one of them is a substituted or unsubstituted benzyl group and the rest of the groups are the same or different substituted or unsubstituted phenyl groups. Most preferred phosphonium cations include tetraphenylphosphonium and benzyltriphenylphosphonium ions.

$R^{29}$ is a substituted or unsubstituted alkylene group having 2 to 10 carbon atoms or arylene group having 6 or 10 atoms in the aromatic ring. Such groups can be defined similarly to the alkyl and aryl groups described above, that is, the arylene group can be carbocyclic or heterocyclic, but preferably it is carbocyclic. Preferably, $R^{29}$ is a substituted or unsubstituted alkylene group having 1 to 10 carbon atoms in the chain, or a 1,2-, 1,3-, or 1,4-substituted phenyl group.

Representative substituted olefinic co-developers useful in this invention include the following compounds identified as CDP-1 through CDP-12, and mixtures thereof:

CDP-1

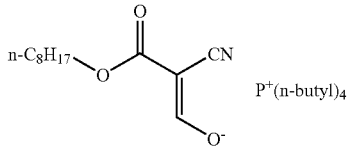

CDP-2

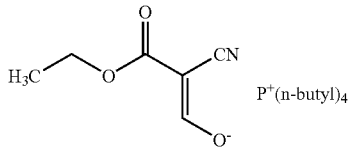

-continued

CDP-3

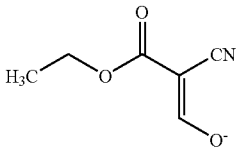

$P^+(phenyl)_3(benzyl)$

CDP-4

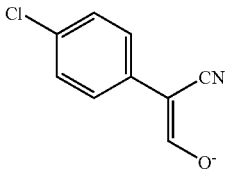

$P^+(n\text{-}butyl)_4$

CDP-5

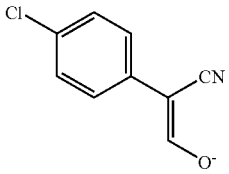

$P^+(phenyl)_3(benzyl)$

CDP-6

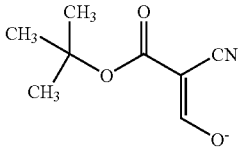

$P^+(n\text{-}butyl)_4$

CDP-7

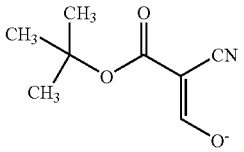

$P^+(n\text{-}butyl)_3(C_{16}H_{33})$

CDP-8

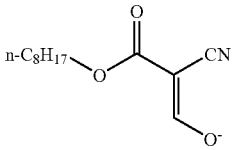

$P^+(phenyl)_3(2\text{-}methylbutyl)$

CDP-9

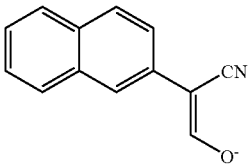

$P^+(n\text{-}butyl)_4$

CDP-10

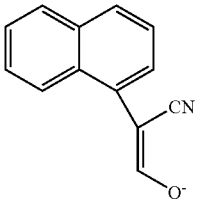

$P^+(phenyl)_3(benzyl)$

CDP-11

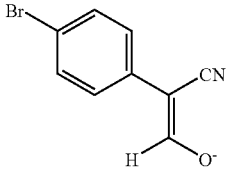

$P^+(phenyl)_3(benzyl)$

-continued

CDP-12

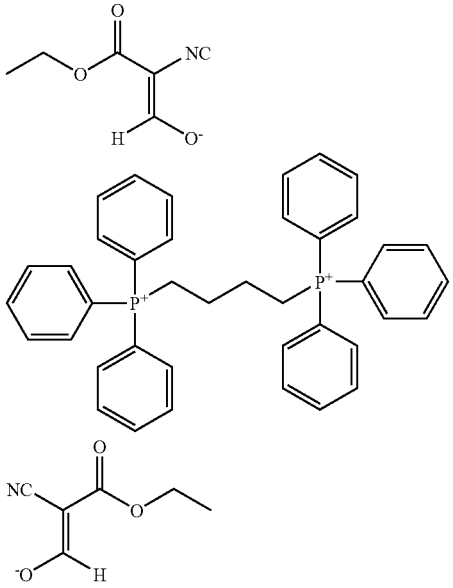

Of these representative compounds, CDP-1, CDP-3, CDP-4, CDP-5, CDP-11, and CDP-12 are preferred and CDP-3, CDP-5, and CDP-11 are most preferred.

One or more substituted olefinic co-developers having phosphonium cations can be added to any layer on the side of the support having a photothermographic emulsion layer as long as they are allowed to come into intimate contact with the emulsion layer during coating, drying, storage, thermal development, or post-processing storage. Thus, one or more of these substituted olefinic co-developers can be added directly to the photothermographic emulsion layer or to one or more overcoat layers above the emulsion layer (for example a topcoat layer, interlayer, or barrier layer) and/or below the emulsion layer (such as to a primer layer, subbing layer, or carrier layer). Preferably one or more of these substituted olefinic co-developers are added directly to the emulsion layer, or to an overcoat layer and allowed to diffuse into the emulsion layer.

Where the photothermographic material has one or more photothermographic layers on both sides of the support, one or more of the same or different substituted olefinic co-developers having phosphonium cations can be used on one or both sides of the support.

Generally, one or more substituted olefinic co-developers having phosphonium cations are present in a total amount of at least 0.001 mmol/$m^2$ in one or more layers on the imaging side of the support (for example, the emulsion layer into which they are incorporated or diffused). Preferably, they are present in a total amount of from about 0.002 mmol/$m^2$ to about 0.02 mmol/$m^2$, and more preferably in a total amount of from about 0.005 to about 0.015 g/$m^2$ in one or more layers on an imaging side of the support. The molar ratio of substituted olefinic co-developer agent with phosphonium cation to trisphenol reducing agent is generally from about 0.001:1 to about 0.02:1, preferably from about 0.002:1 to about 0.01:1.

α-Hydroxymethylene nitriles were prepared according to the method described in U.S. Pat. No. 4,228,087 (Dubois et al.). Thus, phosphonium salts of acrylonitrile co-developers were prepared from the reaction of a corresponding alkali metal salt of the acrylonitrile with tetra-substituted phosphonium chloride, bromide, or tetrafluoroborate in water/methanol solution followed by extraction with chloroform. The following synthetic examples of some co-developers useful in this invention are provided as follows using the noted general procedure.

Preparation of 3-oxo-2-cyanopropanoic acid n-octyl ester tetra-n-butylphosphonium salt (CDP-1)

Into a solution of 3-oxo-2-cyanopropanoic acid n-octyl ester potassium salt (1.27 g, 5 mmol) in methanol (10 ml) was added a solution of tetra-n-butylphosphonium chloride (1.47 g, 5 mmol) in methanol (10 ml). Precipitated potassium chloride was filtered off and water (20 ml) was added to the methanol solution followed by extraction of product with chloroform (2×15 ml). The chloroform solution was dried over $MgSO_4$. Removal of the solvent on a rotary evaporator under reduced pressure gave the desired product (CDP-1) as an oily yellow reside in quantitative yield.

Preparation of 3-oxo-2-cyanopropanoic acid ethyl ester tetra-n-butylphosphonium salt (CDP-2)

Into a solution of 3-oxo-2-cyanopropanoic acid ethyl ester potassium salt (1.8 g, 10 mmol) in water (15 ml) was added a solution of tetra-n-butylphosphonium tetrafluoroborate (3.46 g, 10 mmol) in water (15 ml) followed by extraction of the product with chloroform (2×15 ml). The chloroform solution was dried over $MgSO_4$. Removal of the solvent on a rotary evaporator under reduced pressure gave the desired pure product (CDP-2) as an oily yellow reside in quantitative yield.

Preparation of 3-oxo-2-cyanopropanoic acid ethyl ester benzyltriphenylphosphonium salt (CDP-3)

A solution of benzyltriphenylphosphonium chloride (3.88 g, 10 mmol) in water/methanol (35 ml: 5 ml) was added into a solution of 3-oxo-2-cyanopropanoic acid ethyl ester potassium salt (1.8 g, 10 mmol) in water (20 ml). The reaction mixture was then extracted with chloroform (2×15 ml) and dried over $MgSO_4$. Removal of the solvent on a rotary evaporator under reduced pressure gave the desired product (CDP-3) in quantitative yield as a yellow oily residue.

Preparation of 1-oxo-2-(p-chlorobenzene)acrylonitrile tetra-n-butylphosphonium salt (CDP-4)

CDP-4 was prepared from 1-oxo-2-(p-chlorobenzene) acrylonitrile potassium salt and tetra-n-butylphosphonium bromide similar to the method described above for CDP-1. It was isolated as orange color oil.

Preparation of 1-oxo-2-(p-chlorobenzene)acrylonitrile benzyltriphenylphosphonium salt (CDP-5)

CDP-5 was prepared from 1-oxo-2-(p-chlorobenzene) acrylonitrile potassium salt and benzyltriphenylphosphonium chloride similar to the method described above for CDP-1. It was isolated as orange color solid, which is hygroscopic.

Preparation of 3-oxo-2-cyanopropanoic acid t-butyl ester tetra-n-butylphosphonium salt (CDP-6)

CDP-6 was prepared from 3-oxo-2-cyanopropanoic acid t-butyl ester potassium salt and tetra-n-butylphosphonium chloride similar to the method described above for CDP-1. It was isolated as an orange color oil that crystallized upon standing.

Preparation of 3-oxo-2-cyanopropanoic acid t-butyl ester hexadecyltributylphosphonium salt (CDP-7)

CDP-7 was prepared as described above from potassium salt of 3-oxo-2-cyanopropanoic acid t-butyl ester and hexadecyltributylphosphonium bromide in quantitative yield as an oily residue.

Preparation of 3-oxo-2-cyanopropanoic acid n-octyl ester isoamyltriphenylphosphonium salt (CDP-8)

CDP-8 was prepared similar to the method used to prepare CDP-2 from potassium salt of 3-oxo-2-cyanopropanoic acid n-octyl ester and isoamyltriphenylphosphonium bromide in quantitative yield as a viscose orange color oily residue.

Preparation of 2-Naphthaleneacetonitrile, α-formyl-, tetrabutylphosiphonium salt (CDP-9)

CDP-9 was prepared similar to the method used to prepare CDP-1 from sodium salt of 2-naphthaleneacetonitrile, α-formyl-, and tetra-n-butylphosphonium bromide in quantitative yield as a viscose orange color oily residue.

Preparation of 1-Naphthaleneacetonitrile, α-formyl-, benzyltriphenylphosphonium salt (CDP-10)

CDP-10 was prepared similar to the method used to prepare CDP-9 from the sodium salt of 1-naphthaleneacetonitrile, α-formyl-, and benzyltriphenylphosphonium chloride in quantitative yield as a yellow crystalline material.

Preparation of 1-oxo-2-(p-bromobenzene)acrylonitrile benzyltriphenylphosphonium salt (CDP-11)

CDP-11 was prepared similar to the method used to prepare CDP-1 from the potassium salt of 1-oxo-2-(p-bromobenzene)acrylonitrile and benzyltriphenylphosphonium chloride in quantitative yield as a yellow crystalline material that is hygroscopic.

Preparation of 3-oxo-2-cyanopropanoic acid ethyl ester tetramethylenebis(triphenylphosphonium) salt (CDP-12)

CDP-12 was prepared similar to the method used to prepare CDP-2 from potassium salt of 3-oxo-2-cyanopropanoic acid ethyl ester (1.43 g, 8 mmol) and tetramethylenebis(triphenylphosphonium bromide) (2.96 g, 4 mmol) to give the corresponding product in quantitative yield that is hygroscopic.

Optional additional co-developers can be present in the photothermographic materials but in "minor" amounts, that is at less than 25 mol % of the total co-developers that are present so that the predominant co-developer is the substituted olefinic co-developer with phosphonium cations. These additional co-developers can have other cations including alkali metal, quaternary ammonium, or tertiary sulfonium cations. Alternatively, the additional co-developers can be any of those known in the photothermographic art for this purpose, such as hydrazide co-developers or nucleating agents.

Other Addenda

The photothermographic materials can also contain other additives such as shelf-life stabilizers, antifoggants, toners, development accelerators, acutance dyes, post-processing stabilizers or stabilizer precursors, thermal solvents (also known as melt formers), antistatic or conductive layers, and other image-modifying agents as would be readily apparent to one skilled in the art.

Suitable stabilizers that can be used alone or in combination include thiazolium salts as described in U.S. Pat. No. 2,131,038 (Brooker) and U.S. Pat. No. 2,694,716 (Allen), azaindenes as described in U.S. Pat. No. 2,886,437 (Piper), triazaindolizines as described in U.S. Pat. No. 2,444,605 (Heimbach), the urazoles described in U.S. Pat. No. 3,287,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum, and gold salts as described in U.S. Pat. No. 2,566,263 (Trirelli) and U.S. Pat. No. 2,597,915 (Damshroder), and the heteroaromatic mercapto compounds or heteroaromatic disulfide compounds described in EP 0 559 228B1 (Philip et al.).

Heteroaromatic mercapto compounds are most preferred. Preferred heteroaromatic mercapto compounds include 2-mercaptobenzimidazole, 2-mercapto-5-methylbenzimidazole, 2-mercaptobenzothiazole and 2-mercaptobenzoxazole, and mixtures thereof. A heteroaromatic mercapto compound is generally present in an emulsion layer in an amount of at least 0.0001 mole (preferably from about 0.001 to about 1.0 mole) per mole of total silver in the emulsion layer.

Other useful antifoggants/stabilizers are described in U.S. Pat. No. 6,083,681 (Lynch et al.). Still other antifoggants are hydrobromic acid salts of heterocyclic compounds (such as pyridinium hydrobromide perbromide) as described in U.S. Pat. No. 5,028,523 (Skoug), benzoyl acid compounds as described in U.S. Pat. No. 4,784,939 (Pham), substituted propenenitrile compounds as described in U.S. Pat. No. 5,686,228 (Murray et al.), silyl blocked compounds as described in U.S. Pat. No. 5,358,843 (Sakizadeh et al.), the 1,3-diaryl-substituted urea compounds described in U.S. Pat. No. 7,261,999 (Hunt et al.), and tribromomethylketones as described in EP 0 600 587A1 (Oliff et al.).

Additives useful as stabilizers for improving dark stability and desktop print stability are the various boron compounds described in U.S. Patent Application Publication 2006/0141404 (Philip et al.). The boron compounds are preferably added in an amount of from about 0.010 to about 0.50 g/m$^2$.

Also useful as stabilizers for improving the post-processing print stability of the imaged material to heat during storage (known as "hot-dark print stability") are arylboronic acid compounds as described in U.S. Pat. No. 7,255,982 (Chen-Ho et al.), and sulfonyldiphenols as described in U.S. Pat. No. 7,258,967 (Sakizadeh et al.), both incorporated herein by reference.

The photothermographic materials preferably also include one or more polyhalogen stabilizers that can be represented by the formula Q-(Y)$_n$—C(Z$_1$Z$_2$X) wherein, Q represents an alkyl, aryl (including heteroaryl) or heterocyclic group, Y represents a divalent linking group, n represents 0 or 1, Z$_1$, and Z$_2$ each represents a halogen atom, and X represents a hydrogen atom, a halogen atom, or an electron-withdrawing group. Particularly useful compounds of this type are polyhalogen stabilizers wherein Q represents an aryl group, Y represents (C═O) or SO$_2$, n is 1, and Z$_1$, Z$_2$, and X each represent a bromine atom. Examples of such compounds containing —SO$_2$CBr$_3$ groups are described in U.S. Pat. No. 3,874,946 (Costa et al.), U.S. Pat. No. 5,369,000 (Sakizadeh et al.), U.S. Pat. No. 5,374,514 (Kirk et al.), U.S. Pat. No. 5,460,938 (Kirk et al.), U.S. Pat. No. 5,464,747 (Sakizadeh et al.) and U.S. Pat. No. 5,594,143 (Kirk et al.). Examples of such compounds include, but are not limited to, 2-tribromomethylsulfonyl-5-methyl-1,3,4-thiadiazole, 2-tribromomethylsulfonylpyridine, 2-tribromomethylsulfonylquinoline, and 2-tribromomethylsulfonylbenzene. The polyhalogen stabilizers can be present in one or more layers in a total amount of from about 0.005 to about 0.01 mol/mol of total silver, and preferably from about 0.01 to about 0.05 mol/mol of total silver.

Stabilizer precursor compounds capable of releasing stabilizers upon application of heat during imaging can also be used, as described in U.S. Pat. No. 5,158,866 (Simpson et al.), U.S. Pat. No. 5,175,081 (Krepski et al.), U.S. Pat. No. 5,298,390 (Sakizadeh et al.), and U.S. Pat. No. 5,300,420 (Kenney et al.). Also useful are the blocked aliphatic thiol compounds described in U.S. Patent Application Publication 2006/0141403 (Ramsden et al.).

In addition, certain substituted-sulfonyl derivatives of benzotriazoles may be used as stabilizing compounds as described in U.S. Pat. No. 6,171,767 (Kong et al.).

"Toners" or derivatives thereof that improve the image are desirable components of the photothermographic materials. These compounds, when added to the imaging layer, shift the color of the image from yellowish-orange to brown-black or blue-black. Generally, one or more toners described herein are present in an amount of from about 0.01% to about 10% (more preferably from about 0.1% to about 10%), based on the total dry weight of the layer in which the toner is included. Toners may be incorporated in the photothermographic emulsion or in an adjacent non-imaging layer.

Compounds useful as toners are described in U.S. Pat. No. 3,080,254 (Grant, Jr.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willems et al.), U.S. Pat. No. 3,951,660 (Hagemann et al.), U.S. Pat. No. 5,599,647 (Defieuw et al.) and GB 1,439,478 (AGFA).

Additional useful toners are substituted and unsubstituted mercapto-triazoles as described in U.S. Pat. No. 3,832,186 (Masuda et al.), U.S. Pat. No. 6,165,704 (Miyake et al.), U.S. Pat. No. 5,149,620 (Simpson et al.), U.S. Pat. No. 6,713,240 (Lynch et al.), and U.S. Pat. No. 6,841,343 (Lynch et al.).

Phthalazine and phthalazine derivatives [such as those described in U.S. Pat. No. 6,146,822 (Asanuma et al.)], phthalazinone, and phthalazinone derivatives are particularly useful toners.

Useful phthalazinone compounds are those having sufficient solubility to completely dissolve in the formulation from which they are coated. Preferred phthalazinone compounds include 6,7-dimethoxy-1-(2H)-phthalazinone, 4-(4-pentylphenyl)-1-(2H)-phthalazinone, and 4-(4-cyclohexylphenyl)-1-(2H)-phthalazinone. Mixtures of such phthalazinone compounds can be used if desired.

The addition of development accelerators that increase the rate of image development and allow reduction in silver coating weight is also useful. Suitable development accelerators include phenols, naphthols, and hydrazinecarboxamides. Such compounds are described, for example, in Y. Yoshioka, K. Yamane, T. Ohzeki, *Development of Rapid Dry Photothermographic Materials with Water-Base Emulsion Coating Method*, AgX 2004: The International Symposium on Silver Halide Technology "At the Forefront of Silver Halide Imaging", Final Program and Proceedings of IS&T and SPSTJ, Ventura, Calif., Sep. 13-15, 2004, pp. 28-31, Society for Imaging Science and Technology, Springfield, Va., U.S. Pat. No. 6,566,042 (Goto et al.), U.S. Patent Application Publications 2004/234906 (Ohzeki et al.), 2005/048422 (Nakagawa), 2005/118542 (Mori et al.), (Nakagawa), and 2006/0014111 (Goto).

Thermal solvents (or melt formers) can also be used, including combinations of such compounds (for example, a combination of succinimide and dimethylurea). Thermal solvents are compounds which are solids at ambient temperature but which melt at the temperature used for processing. The thermal solvent acts as a solvent for various components of the photothermographic material, it helps to accelerate thermal development and it provides the medium for diffusion of various materials including silver ions and/or complexes and reducing agents. Known thermal solvents are disclosed in U.S. Pat. No. 3,438,776 (Yudelson), U.S. Pat. No. 5,064,753 (noted above) U.S. Pat. No. 5,250,386 (Aono et al.), U.S. Pat. No. 5,368,979 (Freedman et al.), U.S. Pat. No. 5,716,772 (Taguchi et al.), and U.S. Pat. No. 6,013,420 (Windender). Thermal solvents are also described in U.S. Patent Application Publication 2006/240366 (Chen-Ho et al.).

The photothermographic materials can also include one or more image stabilizing compounds that are usually incorporated in a "backside" layer. Such compounds can include phthalazinone and its derivatives, pyridazine and its derivatives, benzoxazine and benzoxazine derivatives, benzothiazine dione and its derivatives, and quinazoline dione and its derivatives, particularly as described in U.S. Pat. No. 6,599,685 (Kong). Other useful backside image stabilizers include anthracene compounds, coumarin compounds, benzophenone compounds, benzotriazole compounds, naphthalic acid imide compounds, pyrazoline compounds, or compounds described in U.S. Pat. No. 6,465,162 (Kong et al) and GB 1,565,043 (Fuji Photo).

Phosphors are materials that emit infrared, visible, or ultraviolet radiation upon excitation and can be incorporated into the photothermographic materials. Particularly useful phosphors are sensitive to X-radiation and emit radiation primarily in the ultraviolet, near-ultraviolet, or visible regions of the spectrum (that is, from about 100 to about 700 nm). An intrinsic phosphor is a material that is naturally (that is, intrinsically) phosphorescent. An "activated" phosphor is one composed of a basic material that may or may not be an intrinsic phosphor, to which one or more dopant(s) has been intentionally added. These dopants or activators "activate" the phosphor and cause it to emit ultraviolet or visible radiation. Multiple dopants may be used and thus the phosphor would include both "activators" and "co-activators".

Any conventional or useful phosphor can be used, singly or in mixtures. For example, useful phosphors are described in numerous references relating to fluorescent intensifying screens as well as U.S. Pat. No. 6,440,649 (Simpson et al.) and U.S. Pat. No. 6,573,033 (Simpson et al.) that are directed to photothermographic materials. Some particularly useful phosphors are primarily "activated" phosphors known as phosphate phosphors and borate phosphors. Examples of these phosphors are rare earth phosphates, yttrium phosphates, strontium phosphates, or strontium fluoroborates (including cerium activated rare earth or yttrium phosphates, or europium activated strontium fluoroborates) as described in U.S. Patent Application Publication 2005/0233269 (Simpson et al.).

The one or more phosphors can be present in the photothermographic materials in an amount of at least 0.1 mole per mole, and preferably from about 0.5 to about 20 mole, per mole of total silver in the photothermographic material. As noted above, generally, the amount of total silver is at least 0.002 mol/m$^2$. While the phosphors can be incorporated into any imaging layer on one or both sides of the support, it is preferred that they be in the same layer(s) as the photosensitive silver halide(s) on one or both sides of the support.

Binders

The photosensitive silver halide (when present), the non-photosensitive source of reducible silver ions, the reducing agent composition, substituted olefinic co-developer with phosphonium cation, and any other imaging layer additives are generally combined with one or more binders that are generally hydrophobic or hydrophilic in nature. Thus, either aqueous or organic solvent-based formulations can be used to prepare the thermally developable materials. Mixtures of either or both types of binders can also be used. It is preferred that the binder be selected from predominantly hydrophobic polymeric materials (at least 50 dry weight % of total binders) and that the imaging layer formulation (and other layer formulations) is coated out of one or more organic solvents (described below).

Examples of typical hydrophobic binders include polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art. Copolymers (including terpolymers) are also included in the definition of polymers. The polyvinyl acetals (such as polyvinyl butyral, polyvinyl acetal, and polyvinyl formal) and vinyl copolymers (such as polyvinyl acetate and polyvinyl chloride) are particularly preferred. Particularly suitable hydrophobic binders are polyvinyl butyral resins that are available under the names MOWITAL® (Kuraray America, New York, N.Y.), S-LEC® (Sekisui Chemical Company, Troy, Mich.), BUTVAR® (Solutia, Inc., St. Louis, Mo.) and PIOLOFORM® (Wacker Chemical Company, Adrian, Mich.).

Hydrophilic binders or water-dispersible polymeric latex polymers can also be present in the formulations. Examples of useful hydrophilic binders include, but are not limited to, proteins and protein derivatives, gelatin and gelatin-like derivatives (hardened or unhardened), cellulosic materials such as hydroxymethyl cellulose and cellulosic esters, acrylamide/methacrylamide polymers, acrylic/methacrylic polymers polyvinyl pyrrolidones, polyvinyl alcohols, poly(vinyl lactams), polymers of sulfoalkyl acrylate or methacrylates, hydrolyzed polyvinyl acetates, polyacrylamides, polysaccharides and other synthetic or naturally occurring vehicles commonly known for use in aqueous-based photographic emulsions (see for example, *Research Disclosure,* item 38957, noted above). Cationic starches can also be used as a peptizer for tabular silver halide grains as described in U.S. Pat. No. 5,620,840 (Maskasky) and U.S. Pat. No. 5,667,955 (Maskasky).

One embodiment of the polymers capable of being dispersed in aqueous solvent includes hydrophobic polymers such as acrylic polymers, polyester, rubber (for example, SBR resin), polyurethane, poly(vinyl chloride), poly(vinyl acetate), poly(vinylidene chloride), polyolefin, and the like. As the polymers above, usable are straight chain polymers, branched polymers, or crosslinked polymers. Also usable are the so-called homopolymers in which single monomer is polymerized, or copolymers in which two or more types of monomers are polymerized. In the case of a copolymer, it may be a random copolymer or a block copolymer. The molecular weight of these polymers is, in number average molecular weight, in the range from 5,000 to 1,000,000, preferably from 10,000 to 200,000. Those having too small molecular weight exhibit insufficient mechanical strength on forming the image-forming layer, and those having too large molecular weight are also not preferred because the filming properties result poor. Further, crosslinking polymer latexes are particularly preferred for use.

Styrene-butadiene copolymers are particularly preferable as the polymer latex for use as a binder. The weight ratio of monomer unit for styrene to that of butadiene constituting the styrene-butadiene copolymer is preferably in the range of from 40:60 to 95:5. Further, the monomer unit of styrene and that of butadiene preferably account for 60% by weight to 99% by weight with respect to the copolymer. Moreover, the polymer latex contains acrylic acid or methacrylic acid, preferably, in the range from 1% by weight to 6% by weight, and more preferably, from 2% by weight to 5% by weight, with respect to the total weight of the monomer unit of styrene and that of butadiene. The preferred range of the molecular weight is the same as that described above.

Preferred latexes include styrene (50)-butadiene (47)-methacrylic acid (3), styrene (60)-butadiene (35)-divinylbenzene-methyl methacrylate (3)-methacrylic acid (2), styrene (70.5)-butadiene (26.5)-acrylic acid (3) and commercially available LACSTAR-3307B, 7132C, and Nipol Lx416. Such latexes are described in U.S. Patent Application Publication 2005/0221237 (Sakai et al.).

Hardeners for various binders may be present if desired. Useful hardeners are well known and include diisocyanate compounds as described in EP 0 600 586 B1 (Philip, Jr. et al.), vinyl sulfone compounds as described in U.S. Pat. No. 6,143,487 (Philip, Jr. et al.) and EP 0 640 589 A1 (Gathmann et al.), aldehydes and various other hardeners as described in U.S. Pat. No. 6,190,822 (Dickerson et al.). The hydrophilic binders used in the photothermographic materials are generally partially or fully hardened using any conventional hardener. Useful hardeners are well known and are described, for example, in T. H. James, *The Theory of the Photographic Process*, Fourth Edition, Eastman Kodak Company, Rochester, N.Y., 1977, Chapter 2, pp. 77-8.

Where the proportions and activities of the photothermographic materials require a particular developing time and temperature, the binder(s) should be able to withstand those conditions. When a hydrophobic binder is used, it is preferred that the binder (or mixture thereof) does not decompose or lose its structural integrity at 120° C. for 60 seconds. When a hydrophilic binder is used, it is preferred that the binder does not decompose or lose its structural integrity at 150° C. for 60 seconds. It is more preferred that the binder not decompose or lose its structural integrity at 177° C. for 60 seconds.

The polymer binder(s) is used in an amount sufficient to carry the components dispersed therein. Preferably, a binder is used at a level of from about 10% to about 90% by weight (more preferably at a level of from about 20% to about 70% by weight) based on the total dry weight of the layer. It is particularly useful that the photothermographic materials include at least 50 weight % hydrophobic binders in both imaging and non-imaging layers on both sides of the support (and particularly the imaging side of the support).

Support Materials

The photothermographic materials comprise a polymeric support that is preferably a flexible, transparent film that has any desired thickness and is composed of one or more polymeric materials. They are required to exhibit dimensional stability during thermal development and to have suitable adhesive properties with overlying layers. Useful polymeric materials for making such supports include polyesters [such as poly(ethylene terephthalate) and poly(ethylene naphthalate)], cellulose acetate and other cellulose esters, polyvinyl acetal, polyolefins, polycarbonates, and polystyrenes. Preferred supports are composed of polymers having good heat stability, such as polyesters and polycarbonates. Support materials may also be treated or annealed to reduce shrinkage and promote dimensional stability.

Also useful are transparent, multilayer, polymeric supports comprising numerous alternating layers of at least two different polymeric materials as described in U.S. Pat. No. 6,630,283 (Simpson et al.). Another support comprises dichroic mirror layers as described in U.S. Pat. No. 5,795,708 (Boutet).

Opaque supports can also be used, such as dyed polymeric films and resin-coated papers that are stable to high temperatures.

Support materials can contain various colorants, pigments, antihalation or acutance dyes if desired. For example, the support can include one or more dyes that provide a blue color in the resulting imaged film. Support materials may be treated using conventional procedures (such as corona discharge) to improve adhesion of overlying layers, or subbing or other adhesion-promoting layers can be used.

Photothermographic Formulations and Constructions

An organic solvent-based coating formulation for the photothermographic emulsion layer(s) can be prepared by mixing the various components with one or more binders in a suitable organic solvent system that usually includes one or more solvents such as toluene, 2-butanone (methyl ethyl ketone), acetone, or tetrahydrofuran, or mixtures thereof. Methyl ethyl ketone is a preferred coating solvent.

Alternatively, the desired imaging components can be formulated with a hydrophilic binder (such as gelatin, or a gelatin-derivative), or a hydrophobic water-dispersible polymer latex (such as a styrene-butadiene latex) in water or water-organic solvent mixtures to provide aqueous-based coating formulations.

The photothermographic materials can contain plasticizers and lubricants such as poly(alcohols) and diols as described in U.S. Pat. No. 2,960,404 (Milton et al.), fatty acids or esters as described in U.S. Pat. No. 2,588,765 (Robijns) and U.S. Pat. No. 3,121,060 (Duane), and silicone resins as described in GB 955,061 (DuPont). The materials can also contain inorganic and organic matting agents as described in U.S. Pat. No. 2,992,101 (Jelley et al.) and U.S. Pat. No. 2,701,245 (Lynn). Polymeric fluorinated surfactants may also be useful in one or more layers as described in U.S. Pat. No. 5,468,603 (Kub).

The photothermographic materials may also include a surface protective layer over the one or more emulsion layers. Layers to reduce emissions from the material may also be present, including the polymeric barrier layers described in U.S. Pat. No. 6,352,819 (Kenney et al.), U.S. Pat. No. 6,352,820 (Bauer et al.), U.S. Pat. No. 6,420,102 (Bauer et al.), U.S. Pat. No. 6,667,148 (Rao et al.), and U.S. Pat. No. 6,746,831 (Hunt).

U.S. Pat. No. 6,436,616 (Geisler et al.) describes various means of modifying photothermographic materials to reduce what is known as the "woodgrain" effect, or uneven optical density.

To promote image sharpness, the photothermographic materials can contain one or more layers containing acutance and/or antihalation dyes. These dyes are chosen to have absorption close to the exposure wavelength and are designed to absorb scattered light. One or more antihalation compositions may be incorporated into the support, backside layers, underlayers, or overcoat layers. Additionally, one or more acutance dyes may be incorporated into one or more frontside imaging layers.

Dyes useful as antihalation and acutance dyes include squaraine dyes as described in U.S. Pat. No. 5,380,635 (Gomez et al.), and U.S. Pat. No. 6,063,560 (Suzuki et al.), and EP 1 083 459A1 (Kimura), indolenine dyes as described in EP 0 342 810A1 (Leichter), and cyanine dyes as described in U.S. Pat. No. 6,689,547 (Hunt et al.).

It may also be useful to employ compositions including acutance or antihalation dyes that will decolorize or bleach with heat during processing as described in U.S. Pat. No. 5,135,842 (Kitchin et al.), U.S. Pat. No. 5,266,452 (Kitchin et al.), U.S. Pat. No. 5,314,795 (Helland et al.), and U.S. Pat. No. 6,306,566, (Sakurada et al.), and Japan Kokai 2001-142175 (Hanyu et al.) and 2001-183770 (Hanyu et al.). Useful bleaching compositions are described in Japan Kokai 11-302550 (Fujiwara), 2001-109101 (Adachi), 2001-51371 (Yabuki et al.), and 2000-029168 (Noro).

Other useful heat-bleachable antihalation compositions can include an infrared radiation absorbing compound such as an oxonol dye or various other compounds used in combination with a hexaarylbiimidazole (also known as a "HABI"), or mixtures thereof HABI compounds are described in U.S. Pat. No. 4,196,002 (Levinson et al.), U.S. Pat. No. 5,652,091 (Perry et al.), and U.S. Pat. No. 5,672,562 (Perry et al.). Examples of such heat-bleachable compositions are described for example in U.S. Pat. No. 6,455,210 (Irving et al.), U.S. Pat. No. 6,514,677 (Ramsden et al.), and U.S. Pat. No. 6,558,880 (Goswami et al.).

Under practical conditions of use, these compositions are heated to provide bleaching at a temperature of at least 90° C. for at least 0.5 seconds (preferably, at a temperature of from about 100° C. to about 200° C. for from about 5 to about 20 seconds).

Mottle and other surface anomalies can be reduced by incorporating a fluorinated polymer as described, for example, in U.S. Pat. No. 5,532,121 (Yonkoski et al.) or by using particular drying techniques as described, for example in U.S. Pat. No. 5,621,983 (Ludemann et al.).

It is preferable for the photothermographic material to include one or more radiation absorbing substances that are generally incorporated into one or more photothermographic layer(s) to provide a total absorbance of all layers on that side of the support of at least 0.1 (preferably of at least 0.6) at the exposure wavelength of the photothermographic material. Where the imaging layers are on one side of the support only, it is also desired that the total absorbance at the exposure wavelength for all layers on the backside (non-imaging) side of the support be at least 0.2.

Photothermographic formulations can be coated by various coating procedures including wire wound rod coating, dip coating, air knife coating, curtain coating, slide coating, or extrusion coating using hoppers of the type described in U.S. Pat. No. 2,681,294 (Beguin). Layers can be coated one at a time, or two or more layers can be coated simultaneously by the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613 (Hanzalik et al.), U.S. Pat. No. 5,405,740 (LaBelle), U.S. Pat. No. 5,415,993 (Hanzalik et al.), U.S. Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), and U.S. Pat. No. 5,861,195 (Bhave et al.), and GB 837,095 (Ilford). Atypical coating gap for the emulsion layer can be from about 10 to about 750 μm, and the layer can be dried in forced air at a temperature of from about 20° C. to about 100° C. It is preferred that the thickness of the layer be selected to provide maximum image densities greater than about 0.2, and more preferably, from about 0.5 to 5.0 or more, as measured by an X-rite Model 361/V Densitometer equipped with 301 Visual Optics, available from X-rite Corporation, (Granville, Mich.).

Preferably, two or more layer formulations are simultaneously applied to a support using slide coating techniques, the first layer being coated on top of the second layer while the second layer is still wet. The first and second fluids used to coat these layers can be the same or different solvents. For example, subsequently to, or simultaneously with, application of the emulsion formulation(s) to the support, a protective overcoat formulation can be applied over the emulsion formulation. Simultaneous coating can be used to apply layers on the frontside, backside, or both sides of the support.

In other embodiments, a "carrier" layer formulation comprising a single-phase mixture of two or more polymers described above may be applied directly onto the support and thereby located underneath the emulsion layer(s) as described in U.S. Pat. No. 6,355,405 (Ludemann et al.). The carrier layer formulation can be simultaneously applied with application of the emulsion layer formulation(s) and any overcoat or surface protective layers.

The photothermographic materials can include one or more antistatic or conductive layers agents in any of the layers on either or both sides of the support. Conductive components include soluble salts, evaporated metal layers, or ionic polymers as described in U.S. Pat. No. 2,861,056 (Minsk) and U.S. Pat. No. 3,206,312 (Sterman et al.), insoluble inorganic salts as described in U.S. Pat. No. 3,428,451 (Trevoy), electro-conductive underlayers as described in U.S. Pat. No. 5,310,640 (Markin et al.), electronically-conductive metal antimonate particles as described in U.S. Pat. No. 5,368,995 (Christian et al.), and electrically-conductive metal-containing particles dispersed in a polymeric binder as described in EP 0 678 776 A1 (Melpolder et al.). Particularly useful conductive particles are the non-acicular metal antimonate particles used in a buried backside conductive layer as described and in U.S. Pat. No. 6,689,546 (LaBelle et al.), U.S. Pat. No. 7,018,787 (Ludemann et al.), and U.S. Pat. No. 7,022,467 (Ludemann et al.) and in U.S. Patent Application Publications 2006/0046215 (Ludemann et al.), 2006/0046932, and 2006/0093973 (Ludemann et al.).

It is particularly useful that the conductive layers be disposed on the backside of the support and especially where they are buried or underneath one or more other layers such as backside protective layer(s). Such backside conductive layers typically have a resistivity of about $10^5$ to about $10^{12}$ ohm/sq as measured using a salt bridge water electrode resistivity measurement technique. This technique is described in R. A. Elder *Resistivity Measurements on Buried Conductive Layers*, EOS/ESD Symposium Proceedings, Lake Buena Vista, Fla., 1990, pp. 251-254, incorporated herein by reference. [EOS/ESD stands for Electrical Overstress/Electrostatic Discharge].

Still other conductive compositions include one or more fluoro-chemicals each of which is a reaction product of $R_f$—$CH_2CH_2$—$SO_3H$ with an amine wherein $R_f$ comprises 4 or more fully fluorinated carbon atoms as described in U.S. Pat. No. 6,699,648 (Sakizadeh et al.). Additional conductive compositions include one or more fluorochemicals described in more detail in U.S. Pat. No. 6,762,013 (Sakizadeh et al.).

The photothermographic materials may also usefully include a magnetic recording material as described in *Research Disclosure*, Item 34390, November 1992, or a transparent magnetic recording layer such as a layer containing magnetic particles on the underside of a transparent support as described in U.S. Pat. No. 4,302,523 (Audran et al.).

While the carrier and emulsion layers can be coated on one side of the film support, manufacturing methods can also include forming on the opposing or backside of the polymeric support, one or more additional layers, including a conductive layer, antihalation layer, or a layer containing a matting agent (such as silica), or a combination of such layers. Alternatively, one backside layer can perform all of the desired functions.

In a preferred construction, a conductive "carrier" layer formulation comprising a single-phase mixture of two or more polymers and non-acicular metal antimonate particles, may be applied directly onto the backside of the support and thereby be located underneath other backside layers. The carrier layer formulation can be simultaneously applied with application of these other backside layer formulations.

Layers to promote adhesion of one layer to another are also known, such as those described in U.S. Pat. No. 5,891,610 (Bauer et al.), U.S. Pat. No. 5,804,365 (Bauer et al.), and U.S. Pat. No. 4,741,992 (Przezdziecki). Adhesion can also be promoted using specific polymeric adhesive materials as described in U.S. Pat. No. 5,928,857 (Geisler et al.).

It is also contemplated that the photothermographic materials include one or more photothermographic layers on both sides of the support and/or an antihalation underlayer beneath at least one photothermographic layer on at least one side of the support. In addition, the materials can have an outermost protective layer disposed over all photothermographic layers on both sides of the support.

Imaging/Development

The photothermographic materials can be imaged in any suitable manner consistent with the type of material, using any suitable imaging source to which they are sensitive (typically some type of radiation or electronic signal). In most embodiments, the materials are sensitive to radiation in the range of from about at least 100 nm to about 1400 nm. In some embodiments, they materials are sensitive to radiation in the range of from about 300 nm to about 600 nm, more preferably from about 300 to about 450 nm, even more preferably from a wavelength of from about 360 to 420 nm. In preferred embodiments the materials are sensitized to radiation from about 600 to about 1200 nm and more preferably to infrared radiation from about 700 to about 950 nm. If necessary, sensitivity to a particular wavelength can be achieved by using appropriate spectral sensitizing dyes.

Imaging can be carried out by exposing the photothermographic materials to a suitable source of radiation to which they are sensitive, including X-radiation, ultraviolet radiation, visible light, near infrared radiation, and infrared radiation to provide a latent image. Suitable exposure means are well known and include phosphor emitted radiation (particularly X-ray induced phosphor emitted radiation), incandescent or fluorescent lamps, xenon flash lamps, lasers, laser diodes, light emitting diodes, infrared lasers, infrared laser diodes, infrared light-emitting diodes, infrared lamps, or any other ultraviolet, visible, or infrared radiation source readily apparent to one skilled in the art such as described in *Research Disclosure*, item 38957 (noted above). Particularly useful infrared exposure means include laser diodes emitting at from about 700 to about 950 nm, including laser diodes that are modulated to increase imaging efficiency using what is known as multi-longitudinal exposure techniques as described in U.S. Pat. No. 5,780,207 (Mohapatra et al.). Other exposure techniques are described in U.S. Pat. No. 5,493,327 (McCallum et al.).

The photothermographic materials also can be indirectly imaged using an X-radiation imaging source and one or more prompt-emitting or storage X-radiation sensitive phosphor screens adjacent to the photothermographic material. The phosphors emit suitable radiation to expose the photothermographic material. Preferred X-ray screens are those having phosphors emitting in the near ultraviolet region of the spectrum (from 300 to 400 nm), in the blue region of the spectrum (from 400 to 500 nm), and in the green region of the spectrum (from 500 to 600 nm).

In other embodiments, the photothermographic materials can be imaged directly using an X-radiation imaging source to provide a latent image.

Thermal development conditions will vary, depending on the construction used but will typically involve heating the imagewise exposed photo-thermographic material at a suitably elevated temperature, for example, at from about 50° C. to about 250° C. (preferably from about 80° C. to about 200° C. and more preferably from about 100° C. to about 200° C.) for a sufficient period of time, generally from about 1 to about 120 seconds. Heating can be accomplished using any suitable heating means such as contacting the material with a heated drum, plates, or rollers, or by providing a heating resistance layer on the rear surface of the material and supplying electric current to the layer so as to heat the material. A preferred heat development procedure for photothermographic materials includes heating within a temperature range of from 110 to 150° C. for 25 seconds or less, for example, at least 3 and up to 25 seconds (and preferably for 20 seconds or less) to develop the latent image into a visible image having a maximum density ($D_{max}$) of at least 3.0. Line speeds during development of greater than 61 cm/min, such as from 61 to 200 cm/min, can be used.

Thermal development of photothermographic materials is carried out with the material being in a substantially water-free environment and without application of any solvent to the material.

Use as a Photomask

The photothermographic materials can be sufficiently transmissive in the range of from about 350 to about 450 nm in non-imaged areas to allow their use in a method where there is a subsequent exposure of an ultraviolet or short wavelength visible radiation sensitive imageable medium. The photothermographic materials absorb ultraviolet or short wavelength visible radiation in the areas where there is a visible image and transmit ultraviolet or short wavelength visible radiation where there is no visible image. The photothermographic materials may then be used as a mask and positioned between a source of imaging radiation (such as an ultraviolet or short wavelength visible radiation energy source) and an imageable material that is sensitive to such imaging radiation, such as a photopolymer, diazo material, photoresist, or photosensitive printing plate. Exposing the imageable material to the imaging radiation through the visible image in the exposed and heat-developed photothermographic material provides an image in the imageable material. This method is particularly useful where the imageable medium comprises a printing plate and the photothermographic material serves as an image-setting film.

Thus, in some other embodiments wherein the photothermographic material comprises a transparent support, the image-forming method further comprises, after steps (A) and (B) or step (A') noted above:

(C) positioning the exposed and heat-developed photothermographic material between a source of imaging radiation and an imageable material that is sensitive to the imaging radiation, and (D) exposing the imageable material to the imaging radiation through the visible image in the exposed and heat-developed photothermographic material to provide an image in the imageable material.

The following examples are provided to illustrate the practice of the present invention and the invention is not meant to be limited thereby.

Materials and Methods for the Examples:

All materials used in the following examples are readily available from standard commercial sources, such as Aldrich Chemical Co. (Milwaukee Wis.) unless otherwise specified. All percentages are by weight unless otherwise indicated. The following additional terms and materials were used.

Many of the chemical components used herein are provided as a solution. The term "active ingredient" means the amount or the percentage of the desired chemical component contained in a sample. All amounts listed herein are the amount of active ingredient added unless otherwise specified.

PARALOID® A-21 is an acrylic copolymer available from Rohm and Haas (Philadelphia, Pa.).

BZT is benzotriazole.

CAB 171-15S is a cellulose acetate butyrate resin available from Eastman Chemical Co (Kingsport, Tenn.).

DESMODUR® N3300 is a trimer of an aliphatic hexamethylene diisocyanate available from Bayer Chemicals (Pittsburgh, Pa.).

PIOLOFORM® BL-16 is reported to be a polyvinyl butyral resin having a glass transition temperature of about 84° C. PIOLOFORM® BM-18 is reported to be a polyvinyl butyral resin having glass transition temperature of about 70° C. Both are available from Wacker Polymer Systems (Adrian, Mich.).

MEK is methyl ethyl ketone (or 2-butanone).

Vinyl Sulfone-1 (VS-1) is described in U.S. Pat. No. 6,143,487 and has the structure shown below.

(VS-1)

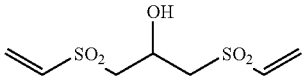

Antifoggant AF-A is 2-pyridyltribromomethylsulfone and has the structure shown below.

(AF-A)

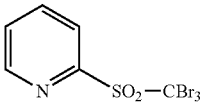

Antifoggant AF-B is ethyl-2-cyano-3-oxobutanoate. It is described in U.S. Pat. No. 5,686,228 (Murray et al.) and has the structure shown below.

(AF-B)

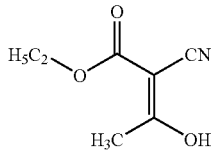

Acutance Dye AD-1 has the following structure:

(AD-1)

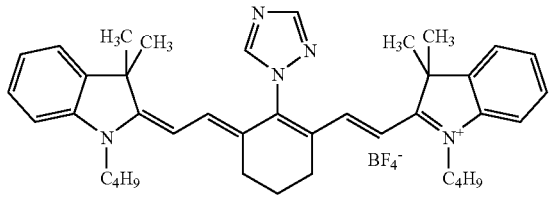

Tinting Dye TD-1 has the following structure:

(TD-1)

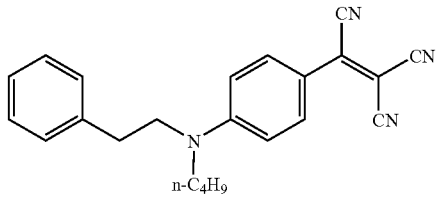

Sensitizing Dye A is described in U.S. Pat. No. 5,541,054 (Miller et al.) has the structure shown below.

(Sensitizing Dye A)

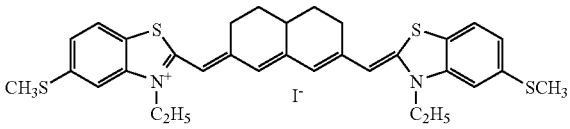

Support Dye SD-1 has the following structure:

(SD-1)

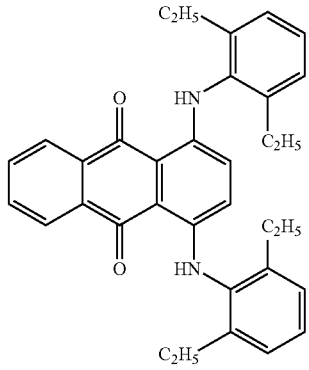

The olefinic co-developers having phosphonium cations used in the Examples according to this invention are identified in relation to the list of "CDP" compounds shown above.

The olefinic co-developers outside of the scope of the present invention ("comparatives") are identified in the Examples as follows as COMP CD-1 though COMP CD-10:

COMP CD-1

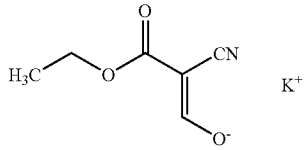

COMP CD-2

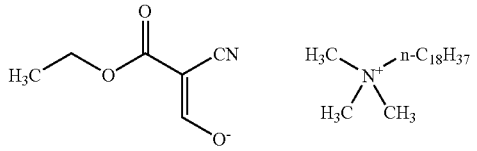

COMP CD-3

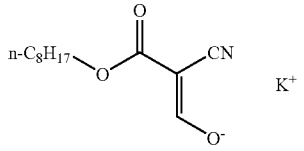

COMP CD-4

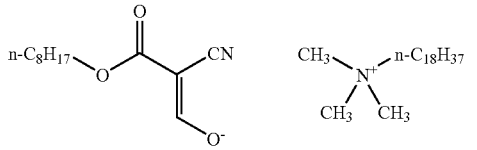

COMP CD-5

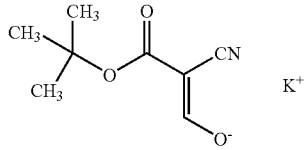

COMP CD-6

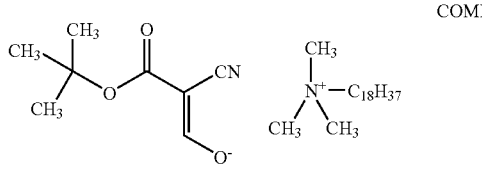

COMP CD-7

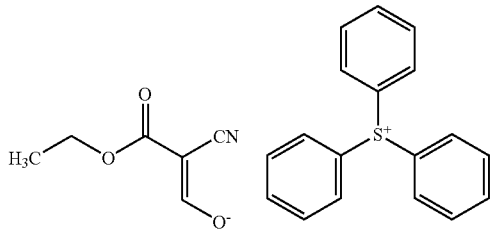

-continued

COMP CD-8

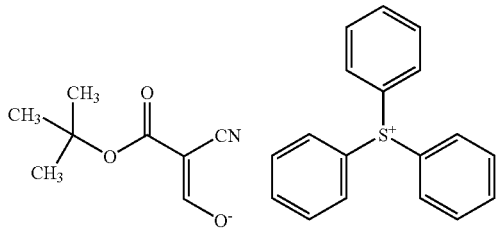

COMP CD-9

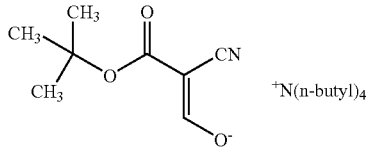

COMP CD-10

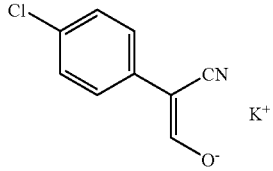

The various comparative co-developers noted above were prepared using several synthetic methods. For example, these materials were prepared similarly to the procedure described above for the phosphonium salts used in the practice of the present invention except that tetra-substituted ammonium halides and tri-substituted sulfonium halides were employed. Comparative compounds COMP CD-1, COMP CD-3 and COMP CD-5 were prepared using similar or modified procedures described in U.S. Pat. No. 5,545,515 (Murray et al.), which is incorporated herein by reference. Comparative example COMP CD-10 was prepared using the method described in U.S. Pat. No. 5,654,130 (Murray), which is also incorporated herein by reference. Specific synthetic examples are as follows:

Preparation of 3-oxo-2-cyanopropanoic acid ethyl ester octadecyltrimethylammonium salt (COMP CD-2)

A solution of trimethylstearylammonium chloride (1.74 g, 5 mmol) in water (60 ml) was added into a solution of potassium salt of 3-oxo-2-cyanoprpanoic acid ethyl ester (0.895 g, 5 mmol) in water (20 ml) to give a yellow color gel. The gel was dissolved in 40 ml methanol and extracted with chloroform (2×15 ml) followed by drying over $MgSO_4$. Removal of the solvent on a rotary evaporator under reduced pressure gave the desired product as yellow color residue that solidified by keeping in dry ice. Yield 1.82 g (80%).

Preparation of 3-oxo-2-cyanopropanoic acid n-octyl ester octadecyltrimethylammonium salt (COMP CD-4)

A solution of trimethylstearylammonium chloride (3.48 g, 10 mmol) in water (120 ml) was added into a solution of potassium salt of 3-oxo-2-cyanoprpanoic acid n-octyl ester (2.63 g, 10 mmol) in methanol (20 ml) to give a yellow solution of fine dispersions. This was dissolved by adding more methanol (150 ml) into the reaction mixture and extracting it with chloroform (2×25 ml) followed by drying over $MgSO_4$. Removal of the solvent on a rotary evaporator under reduced pressure gave desired product as a bright yellow color crystalline material. Yield 4.5 g (84%).

Preparation of 3-oxo-2-cyanopropanoic acid t-butyl ester octadecyltrimethylammonium salt (COMP CD-6)

A solution of trimethylstearylammonium chloride (3.48 g, 10 mmol) in water (120 ml) was added into a solution of potassium salt of 3-oxo-2-cyanopropanoic acid t-butyl ester (2.072 g, 10 mmol) in methanol (20 ml) to give a yellow color gel. The gel-like solution turned clear by addition of more methanol (50 ml) into the reaction mixture. This was extracted with chloroform (2×25 ml) followed by drying over $MgSO_4$. Removal of the solvent on a rotary evaporator under reduced pressure gave the desired product as a yellow residue that turned into a fine powder by treating it with n-heptane. Yield 4.6 g (96%).

Preparation of 3-oxo-2-cyanopropanoic acid ethyl ester triphenylsulfonium salt (COMP CD-7)

Into a solution of potassium salt of 3-oxo-2-cyanopropanoic acid ethyl ester (1.79 g, 10 mmol) in water (10 ml) was added a 50% solution of triphenylsulfonium chloride in water (5.96 g, 10 mmol). The reaction mixture turned cloudy. Water (15 ml) was added and the mixture was extracted with chloroform (2×25 ml) followed by drying over $MgSO_4$. The removal of the solvent on a rotary evaporator under reduced pressure gave desired product as yellow crystalline material. Yield 3.2 g (80%).

Preparation of 3-oxo-2-cyanopropanoic acid t-butyl ester triphenylsulfonium salt (COMP CD-8)

COMP CD-8 was prepared similar to COMP CD-7 at 79% yield from potassium salt of 3-oxo-2-cyanopropanoic acid t-butyl ester (2.07 g, 10 mmol) and 50% solution of triphenylsulfonium chloride in water (5.96 g, 10 mmol) as a yellow color, light weight (fluffy) crystalline material.

Preparation of 3-oxo-2-cyanopropanoic acid t-butyl ester tetra-n-butylammonium salt (COMP CD-9)

COMP CD-9 was prepared at 88% yield similar to the method described for preparing COMP CD-6 from the potassium salt of 3-oxo-2-cyanoprpanoic acid t-butyl ester and tetra-n-butylammonium bromide.

EXAMPLE 1

Invention and Comparative

This example demonstrates that use of the olefinic benzyl triphenylphosphonium co-developer according to this invention provided improved image tone.

Preparation of Photothermographic Emulsion Formulation:

A photothermographic emulsion formulation was prepared as follows:

A preformed silver halide, silver carboxylate soap dispersion, was prepared in similar fashion to that described in U.S. Pat. No. 5,939,249 (noted above). The core shell silver halide emulsion had a silver iodobromide core with 8% iodide, and a silver bromide shell doped with iridium and copper. The core made up 25% of each silver halide grain, and the shell made up the remaining 75%. The silver halide grains were cubic in shape, and had a mean grain size between 0.055 and 0.06 μm. The preformed silver halide, silver carboxylate soap dispersion was made by mixing 26.1% preformed silver halide, silver carboxylate soap, 2.1% PIOLOFORM® BM-18 polyvinyl butyral binder, and 71.8% MEK, and homogenizing three times at 8000 psi (55 MPa).

A photothermographic emulsion formulation was prepared containing 174 parts of the above preformed silver halide, silver carboxylate soap dispersion and 4.6 parts of MEK. To this formulation was added 1.6 parts of a 15% solution of pyridinium hydrobromide perbromide in methanol, with stirring. After 45 minutes of mixing, 2.1 parts of an 11% zinc bromide solution in methanol was added. Stirring was continued and after 30 minutes, a solution of 0.18 parts 2-mercapto-5-methyl-benzimidazole, 0.009 parts of Sensitizing Dye A, 2.0 parts of 2-(4-chloro-benzoyl)benzoic acid, 10.8 parts of methanol, and 3.4 parts of MEK were added. After stirring for 75 minutes, the temperature was lowered to 10° C., and 37.6 parts of PIOLOFORM® BM 18, 21.2 parts of PIOLOFORM® BL-16, and 50.9 parts of MEK were added. Mixing was continued for another 15 minutes.

The formulation was completed by adding the materials shown below. Five minutes were allowed between the additions of each component.

| | |
|---|---|
| Developer I-2 (from TABLE I) | 4.42 parts |
| Developer III-1 (from TABLE III) | 2.18 parts |
| Solution A containing: | |
| Antifoggant AF-A | 0.80 parts |
| Tetrachlorophthalic acid (TCPA) | 0.37 parts |
| 4-Methylphthalic acid (4 MPA) | 0.71 parts |
| MEK | 21 parts |
| Methanol | 0.36 parts |
| DESMODUR ® N3300 | 0.66 parts in 0.33 parts MEK |
| Phthalazine (PHZ) | 1.4 parts in 6.3 parts MEK |

To 28.37 parts of the completed formulation described above was added either the comparative olefinic co-developer (COMP CD-1) as a solution of $1.34\times10^{-4}$ moles per 6.75 g of methanol or the inventive olefinic co-developer CDP-3 as a solution of $1.34\times10^{-4}$ moles per 3.37 g of methanol and 3.38 g of methyl ethyl ketone as described in TABLE IV below. Mixing was continued for another 15 minutes.

Overcoat Formulation:

The overcoat formulation was prepared by mixing the following materials:

| | |
|---|---|
| MEK | 290 parts |
| PARALOID ® A-21 | 1.85 parts |
| CAB 171-15S | 20.3 parts |
| Vinyl Sulfone VS-1 | 0.96 parts, 80.8% active (0.78 parts net) |
| Benzotriazole (BZT) | 0.29 parts |
| Acutance Dye AD-1 | 0.50 parts |
| Antifoggant AF-B | 0.51 parts |
| DESMODUR ® N3300 Solution | 1.54 parts, in 0.76 parts MEK |
| Tinting Dye TD-1 | 0.013 parts |

Preparation of Photothermographic Materials:

The photothermographic emulsion and topcoat formulations were simultaneously coated onto a 7 mil (178 μm) polyethylene terephthalate support, tinted blue with support dye SD-1. An automated dual knife coater equipped with an in-line dryer was used. Immediately after coating, samples were dried in a forced air oven at between 90 and 97° C. for between 4 and 6 minutes. The photothermographic emulsion formulation was coated to obtain a coating weight of between about 1.45 and 1.55 g of total silver/$m^2$ (between about 0.0135 and 0.0144 mol/$m^2$). The topcoat formulation was coated to obtain about a dry coating weight of about 0.2 g/$ft^2$ (2.2 g/$m^2$) and an absorbance in the imaging layer of about 1.45 to 1.5 at 815 nm.

The backside of the support had been coated with an antihalation and antistatic layer having an absorbance greater than 0.3 between 805 and 815 nm, and a resistivity of less than $10^{11}$ ohms/square.

Samples of each photothermographic material were cut into strips, exposed with a laser sensitometer at 810 nm, and thermally developed to generate continuous tone wedges with image densities varying from a minimum density (Dmin) to a maximum density (Dmax) possible for the exposure source and development conditions. Development was carried out on a 6 inch diameter (15.2 cm) heated rotating drum. The strip contacted the drum for 210 degrees of its revolution, about 11 inches (28 cm). Samples were developed at 122.5° C. for 15 seconds at a rate of 0.733 inches/sec (112 cm/min). The samples were equilibrated 2 hours after exposure but before development at less than 32% RH at 70° F. (21° C.). The drum development occurred at the dry environmental conditions.

A strip sample of each photothermographic material was scanned using a computerized densitometer equipped with both a visible filter and a blue filter having peak transmission at about 440 nm. The Dmin, Dmax, AC-1, Speed-2, Silver Efficiency, and Image Tone obtained at dry humidity less than 32% RH and 70° F. (21° C.) using the visible filter are shown in TABLE IV below.

Calculation of Silver Efficiency:

Silver efficiency was calculated for each sample by dividing $D_{max}$ by the silver coating weight. The silver coating weight of each film sample was measured by X-ray fluorescence using commonly known techniques.

Evaluation of Image Tone:

A strip sample of each photothermographic material was scanned using a computerized densitometer equipped with both a visible filter and a blue filter having peak transmission at about 440 nm. Image tone, measured at a visible density of 1.5, is the difference of the blue filter density from 1.5. Image tone, measured at a visible density of 2.0, is the difference of the blue filter density from 2.0. Image tone, measured at a visible density of 2.5, is the difference of the blue filter density from 2.5. Larger Image Tone values indicate a bluer image.

The olefinic co-developer used in Comparative Sample 1-1 (COMP CD-1 had a potassium cation. The inventive olefinic co-developer used in Inventive Sample 1-2 (CDP-3) had a benzyl triphenylphosphonium cation. The molar amount of the inventive co-developer was comparable to the molar equivalent of the co-developer in Comparative Sample 1-1. The Silver Efficiency values and sensitometry were similar for the Comparative Sample 1-1 and the Inventive Sample 1-2 as shown below in TABLE IV The photothermographic material of this invention provided an image with bluer image tone as evidenced by the larger Image Tone values.

TABLE IV

| Sample | Olefinic Co-Developer | Amount ($\times 10^{-6}$ moles) | Dmin | Dmax | Speed-2 | AC1 | Silver Efficiency Dmax/Ag (Coating Wt.) | Image Tone at D = 1.5 | Image Tone at D = 2.0 | Image Tone at D = 2.5 |
|---|---|---|---|---|---|---|---|---|---|---|
| 1-1-Comparative | COMP CD-1 | 7.6 | 0.220 | 3.72 | 1.72 | 3.29 | 2.43 | 0.08 | 0.05 | −0.02 |
| 1-2-Inventive | CDP-3 | 7.6 | 0.215 | 3.59 | 1.67 | 3.02 | 2.48 | 0.14 | 0.11 | 0.06 |

EXAMPLE 2

Invention and Comparative

This example demonstrates that the use of an olefinic co-developer having a tetra-n-butylphosphonium cation according to this invention provided improved image tone.

The photothermographic emulsion and topcoat formulations were prepared as described in Example 1 except the photothermographic emulsion formulation was coated to obtain a coating weight of between about 1.52 and 1.58 g of total silver/$m^2$ (between about 0.0141 and 0.0146 mol/$m^2$). The absorbance in the imaging layer was about 1.40 to 1.45 at 815 nm.

The backside of the support had been coated with an antihalation and antistatic layer having an absorbance greater than 0.3 between 805 and 815 nm, and a resistivity of less than $10^{11}$ ohms/square.

Samples of each photothermographic material were imaged, developed, and equilibrated as described in Example 1.

A strip sample of each photothermographic material was scanned using a computerized densitometer equipped with both a visible filter and a blue filter having peak transmission at about 440 nm. The $D_{min}$, $D_{max}$, Speed-2, AC 1, Silver Efficiency, and Image Tone obtained at dry humidity less than 32% RH and 70° F. (21° C.) using the visible filter are shown below in TABLE V The olefinic co-developer used in Comparative Sample 2-1 (COMP CD-10) had a potassium cation while the inventive olefinic co-developer used in Inventive Sample 2-2 (CDP-4) had a tetra-n-butylphosphonium cation. The molar amount of the inventive co-developer was comparable to the molar equivalent of the co-developer used in Comparative Sample 2-1. The Silver Efficiency values and sensitometry were similar for the Comparative Sample 2-1 and Inventive Sample 2-2 as shown below in TABLE V. The photothermographic material of this invention provided an image with a bluer image tone as evidenced by the larger Image Tone values.

TABLE V

| Sample | Olefinic Co-Developer | Amount ($\times 10^{-6}$ moles) | Dmin | Dmax | Speed-2 | AC1 | Silver Efficiency Dmax/Ag (Coating Wt.) | Image Tone at D = 1.5 | Image Tone at D = 2.0 | Image Tone at D = 2.5 |
|---|---|---|---|---|---|---|---|---|---|---|
| 2-1-Comparative | COMP CD-10 | 7.6 | 0.222 | 4.17 | 2.05 | 6.84 | 2.71 | 0.09 | 0.03 | −0.05 |
| 2-2-Inventive | CDP-4 | 7.6 | 0.219 | 4.13 | 2.04 | 6.18 | 2.65 | 0.08 | 0.04 | −0.01 |

EXAMPLE 3

Comparitives

This example demonstrates that the use of an olefinic co-developer having a triphenylsulfonium cation or a tetra-n-butylammonium cation provided less bluer image tone than an olefinic co-developer having a potassium cation.

The photothermographic emulsion and topcoat formulations were prepared as described in Example 1 except the photothermographic emulsion formulation was coated to obtain a coating weight of between about 1.45 and 1.52 g of total silver/m$^2$ (between about 0.0135 and 0.0141 mol/m$^2$). The absorbance in the imaging layer was about 1.35 to 1.42 at 815 nm.

The backside of the support had been coated with an antihalation and antistatic layer having an absorbance greater than 0.3 between 805 and 815 nm, and a resistivity of less than $10^{11}$ ohms/square.

Samples of each photothermographic material were imaged, developed, and equilibrated as described in Example 1.

A strip sample of each photothermographic material was scanned using a computerized densitometer equipped with both a visible filter and a blue filter having peak transmission at about 440 nm. The $D_{min}$, $D_{max}$, Speed-2, AC 1, Silver Efficiency, and Image Tone obtained at dry humidity less than 32% RH and 70° F. (21° C.) using the visible filter are shown in TABLE VI below.

The olefinic co-developer used in Comparative Sample 3-1 (COMP CD-5) had a potassium cation, the olefinic co-developer used in Comparative Sample 3-2 (COMP CD-8) had a triphenylsulfonium cation, and the olefinic co-developer used in Comparative Sample 3-3 (COMP CD-9) had a tetra-n-butylammonium cation. The molar amount of the co-developers in Comparative Samples 3-2 and 3-3 were higher than the molar equivalent of the co-developer used in Comparative Sample 3-1 as Comparative Samples 3-2 and 3-3 were less reactive at the same molar equivalence. The Silver Efficiency values and sensitometry were slightly less reactive for the Comparative Sample 3-1 than the Comparative Samples 3-2 and 3-3 in TABLE VI. The co-developers used in Comparative Samples 3-2 and 3-3 provided less bluer image tone as the Comparative Sample 3-1 as evidenced by the smaller Image Tone values.

TABLE VI

| Sample | Olefinic Co-Developer | Amount ($\times 10^{-6}$ moles) | Dmin | Dmax | Speed-2 | AC1 | Silver Efficiency Dmax/Ag (Coating Wt.) | Image Tone at D = 1.5 | Image Tone at D = 2.0 | Image Tone at D = 2.5 |
|---|---|---|---|---|---|---|---|---|---|---|
| 3-1-Comparative | COMP CD-5 | 8.9 | 0.218 | 3.50 | 1.67 | 2.67 | 2.35 | 0.11 | 0.09 | 0.04 |
| 3-2-Comparative | COMP CD-8 | 11.4 | 0.217 | 3.77 | 1.72 | 3.38 | 2.48 | 0.09 | 0.05 | 0.00 |
| 3-3-Comparative | COMP CD-9 | 11.4 | 0.217 | 3.69 | 1.70 | 3.11 | 2.43 | 0.10 | 0.07 | 0.01 |

EXAMPLE 4

Comparatives

This example demonstrates that the use of an olefinic co-developer having a triphenylsulfonium cation provided a less bluer image tone than use of a similar co-developer having a potassium cation.

The photothermographic emulsion and topcoat formulations were prepared as described in Example 1 except the photothermographic emulsion formulation contained 1.25 parts 4-methylphthalic acid and was coated to obtain a coating weight of between about 1.45 and 1.55 g of total silver/m$^2$ (between about 0.0135 and 0.0144 mol/m$^2$). The absorbance in the imaging layer was about 1.49 to 1.58 at 815 nm.

The backside of the support had been coated with an antihalation and antistatic layer having an absorbance greater than 0.3 between 805 and 815 nm, and a resistivity of less than $10^{11}$ ohms/square.

Samples of each photothermographic material were imaged, developed, and equilibrated as described in Example 1.

A strip sample of each photothermographic material was scanned using a computerized densitometer equipped with both a visible filter and a blue filter having peak transmission at about 440 nm. The $D_{min}$, $D_{max}$, Speed-2, AC 1, Silver Efficiency, and Image Tone obtained at dry humidity less than 32% RH and 70° F. (21° C.) using the visible filter are shown below in TABLE VII.

The olefinic co-developer used in Comparative Sample 4-1 (COMP CD-5) had a potassium cation and the olefinic co-developer used in Comparative Sample 4-2 (COMP CD-8) had a triphenylsulfonium cation. The molar amount of the co-developer in Comparative Sample 4-2 was higher than the molar equivalent of the co-developer in Comparative Sample 4-1 as Comparative Sample 4-2 was less reactive at the same molar equivalence. The Silver Efficiency values and sensitometry were similar for Comparative Sample 4-1 and Comparative Sample 4-2 in TABLE VII. Comparative Sample 4-2 provided an image with less bluer image tone as did Comparative Sample 4-1 as evidenced by the smaller Image Tone values.

TABLE VII

| Sample | Olefinic Co-Developer | Amount ($\times 10^{-6}$ moles) | Dmin | Dmax | Speed-2 | AC1 | Silver Efficiency Dmax/Ag (Coating Wt.) | Image Tone at D = 1.5 | Image Tone at D = 2.0 | Image Tone at D = 2.5 |
|---|---|---|---|---|---|---|---|---|---|---|
| 4-1-Comparative | COMP CD-5 | 8.9 | 0.216 | 3.68 | 1.64 | 2.55 | 2.37 | 0.13 | 0.09 | 0.06 |
| 4-2-Comparative | COMP CD-8 | 11.4 | 0.216 | 3.59 | 1.61 | 2.51 | 2.43 | 0.10 | 0.07 | 0.01 |

EXAMPLE 5

Comparitives

This example demonstrates that the use of an olefinic co-developer having a triphenylsulfonium cation provided a less bluer image tone than a similar co-developer having a potassium cation.

The photothermographic emulsion and topcoat formulations were prepared as described in Example 1 except the photothermographic emulsion formulation was coated to obtain a coating weight of between about 1.50 and 1.55 g of total silver/$m^2$ (between about 0.0140 and 0.0144 mol/$m^2$). The absorbance in the imaging layer was about 1.55 to 1.65 at 815 nm.

The backside of the support had been coated with an antihalation and antistatic layer having an absorbance greater than 0.3 between 805 and 815 nm, and a resistivity of less than $10^{11}$ ohms/square.

Samples of each photothermographic material were imaged, developed, and equilibrated as described in Example 1.

A strip sample of each photothermographic material was scanned using a computerized densitometer equipped with both a visible filter and a blue filter having peak transmission at about 440 nm. The $D_{min}$, $D_{max}$, Speed-2, AC 1, Silver Efficiency, and Image Tone obtained at dry humidity less than 32% RH and 70° F. (21° C.) using the visible filter are shown below in TABLE VIII.

The co-developer used in Comparative Sample 5-1 (COMP CD-1) had a potassium cation while the co-developer used in Comparative Sample 5-2 (COMP CD-7) had a triphenylsulfonium cation. The molar amount of the co-developer in Comparative Sample 5-2 was higher than the molar equivalent of the co-developer in Comparative Sample 5-1 as the Comparative Sample 5-2 was less reactive at the same molar equivalence. The Silver Efficiency values and sensitometry were similar for the Comparative Sample 5-1 and the Comparative Sample 5-2 as shown in TABLE VIII. Comparative Sample of 5-2 provided an image with less bluer image tone as did Comparative Sample 5-1 as evidenced by the smaller Image Tone values.

EXAMPLE 6

Invention & Comparative

This example demonstrates that using an olefinic co-developer having a tetra-n-butylphosphonium cation according to this invention provided improved image tone.

The photothermographic emulsion and topcoat formulations were prepared as described in Example 1 except the photothermographic emulsion formulation contained 7.95 parts of Developer I-2 only (from TABLE I). To 28.48 g of the completed formulation was added the comparative and inventive compounds as described in Example 1. The photothermographic emulsion formulation was coated to obtain a coating weight of between about 1.40 and 1.52 g of total silver/$m^2$ (between about 0.0130 and 0.0141 mol/$m^2$). The absorbance in the imaging layer was about 1.50 to 1.55 at 815 nm.

The backside of the support had been coated with an antihalation and antistatic layer having an absorbance greater than 0.3 between 805 and 815 nm, and a resistivity of less than $10^{11}$ ohms/square.

Samples of each photothermographic material were imaged, developed, and equilibrated as described in Example 1.

A strip sample of each photothermographic material was scanned using a computerized densitometer equipped with both a visible filter and a blue filter having peak transmission at about 440 nm. The $D_{min}$, $D_{max}$, Speed-2, AC 1, Silver Efficiency, and Image Tone obtained at dry humidity less than 32% RH and 70° F. (21° C.) using the visible filter are shown in the following TABLE IX.

The olefinic co-developer used in Comparative Sample 6-1 (COMP CD-3) had a potassium cation while the inventive co-developer used in Inventive Sample 6-2 (CDP-1) had a tetra-n-butylphosphonium cation. The molar amount of the co-developer in Inventive Sample 6-2 was higher than the molar equivalent of the co-developer used in Comparative Sample 6-1 as the Inventive Sample 6-2 was less reactive at the same molar equivalence. The Silver Efficiency value for the Inventive Sample 6-2 was lower, but the sensitometry was similar for the Comparative Sample 6-1 and the Inventive Sample 6-2 as shown in the following TABLE IX. Use of the inventive co-olefinic developer provided bluer image tone as evidenced by the larger Image Tone values.

TABLE VIII

| Sample | Olefinic Co-Developer | Amount ($\times 10^{-6}$ moles) | Dmin | Dmax | Speed-2 | AC1 | Silver Efficiency Dmax/Ag (Coating Wt.) | Image Tone at D = 1.5 | Image Tone at D = 2.0 | Image Tone at D = 2.5 |
|---|---|---|---|---|---|---|---|---|---|---|
| 5-1-Comparative | COMP CD-1 | 7.6 | 0.223 | 3.78 | 1.68 | 3.01 | 2.50 | 0.08 | 0.03 | −0.03 |
| 5-2-Comparative | COMP CD-7 | 10.2 | 0.222 | 3.83 | 1.72 | 3.39 | 2.49 | 0.04 | −0.02 | −0.08 |

TABLE IX

| Sample | Olefinic Co-Developer | Amount ($\times 10^{-6}$ moles) | Dmin | Dmax | Speed-2 | AC1 | Silver Efficiency Dmax/Ag (Coating Wt.) | Image Tone at D = 1.5 | Image Tone at D = 2.0 | Image Tone at D = 2.5 |
|---|---|---|---|---|---|---|---|---|---|---|
| 6-1-Comparative | COMP CD-3 | 7.6 | 0.209 | 3.70 | 1.68 | 3.40 | 2.60 | 0.09 | 0.07 | 0.05 |
| 6-2-Inventive | CDP-1 | 10.2 | 0.210 | 3.68 | 1.64 | 3.01 | 2.44 | 0.16 | 0.16 | 0.15 |

EXAMPLE 7

Comparitives

This example demonstrates that use of an olefinic co-developer having an octadecyltrimethylammonium cation provided no improved image tone.

The photothermographic emulsion and topcoat formulations were prepared as described in Example 1 except the photothermographic emulsion formulation contained 7.95 parts of Developer I-2 (from TABLE I) only. To 28.48 g of the completed formulation was added each of the comparative compounds as described in Example 1. The photothermographic emulsion formulation was coated to obtain a coating weight of between about 1.45 and 1.52 g of total silver/$m^2$ (between about 0.0135 and 0.0141 mol/$m^2$). The absorbance in the imaging layer was about 1.45 to 1.50 at 815 nm.

The backside of the support had been coated with an antihalation and antistatic layer having an absorbance greater than 0.3 between 805 and 815 nm, and a resistivity of less than $10^{11}$ ohms/square.

Samples of each photothermographic material were imaged, developed, and equilibrated as described in Example 1.

A strip sample of each photothermographic material was scanned using a computerized densitometer equipped with both a visible filter and a blue filter having peak transmission at about 440 nm. The $D_{min}$, $D_{max}$, Speed-2, AC 1, Silver Efficiency, and Image Tone obtained at dry humidity less than 32% RH and 70° F. (21° C.) using the visible filter are shown below in TABLE X.

The olefinic co-developer used in Comparative Sample 7-1 (COMP CD-3) had a potassium cation while the co-developer used in Comparative Sample 7-2 (COMP CD-4) had an octadecyltrimethylammonium cation. The molar amount of the co-developer in Comparative Sample of 7-2 was higher than the molar equivalent of the co-developer used in Comparative Sample 7-1 as Comparative Sample 7-2 was less reactive at the same molar equivalence. The Silver Efficiency values and the sensitometry were similar for Comparative Samples 7-1 and 7-2 as shown in TABLE X. Use of the co-developer in Comparative Sample 7-2 provided the same image tone as provided by Comparative Sample 7-1 as evidenced by the same Image Tone values.

EXAMPLE 8

Comparitives

This example demonstrates that the use of an olefinic co-developer having an octadecyltrimethylammonium cation provided no improved image tone.

The photothermographic emulsion and topcoat formulations were prepared as described in Example 1 except the photothermographic emulsion formulation contained 6.73 parts of Developer III-4 only. To 28.38 g of the completed formulation was added each of the comparative compounds as described in Example 1. The photothermographic emulsion formulation was coated to obtain a coating weight of between about 1.45 and 1.52 g of total silver/$m^2$ (between about 0.0135 and 0.0141 mol/$m^2$). The absorbance in the imaging layer was about 1.45 to 1.55 at 815 nm.

The backside of the support had been coated with an antihalation and antistatic layer having an absorbance greater than 0.3 between 805 and 815 nm, and a resistivity of less than $10^{11}$ ohms/square.

Samples of each photothermographic material were imaged, developed, and equilibrated as described in Example 1.

A strip sample of each photothermographic material was scanned using a computerized densitometer equipped with both a visible filter and a blue filter having peak transmission at about 440 nm. The $D_{min}$, $D_{max}$, Speed-2, AC 1, Silver Efficiency, and Image Tone obtained at dry humidity less than 32% RH and 70° F. (21° C.) using the visible filter are shown in TABLE XI.

The olefinic co-developer used in each of Comparative Samples 8-1 and 8-2 (COMP CD-1) had a potassium cation while the comparative olefinic co-developer used in each of Comparative Samples 8-3 and 8-4 (COMP CD-2) had an octadecyltrimethylammonium cation. The molar amounts of the co-developers in Comparative Samples of 8-3 and 8-4 were the same molar equivalents of the co-developers used in Comparative Samples 8-1 and 8-2, respectively. The Silver Efficiency values and the sensitometry were similar for Comparative Samples 8-1 and 8-2 and Comparative Samples 8-3 and 8-4 as shown in TABLE XI. Use of the co-developers in Comparative Samples 8-3 and 8-4 provided the same image tone as the Comparative Samples 8-1 and 8-2, respectively, as evidenced by the same Image Tone values.

TABLE X

| Sample | Co-Developer | Amount ($\times 10^{-6}$ moles) | Dmin | Dmax | Speed-2 | AC1 | Silver Efficiency Dmax/Ag (Coating Wt.) | Image Tone at D = 1.5 | Image Tone at D = 2.0 | Image Tone at D = 2.5 |
|---|---|---|---|---|---|---|---|---|---|---|
| 7-1-Comparative | COMP CD-3 | 6.4 | 0.212 | 3.59 | 1.63 | 2.73 | 2.43 | 0.11 | 0.07 | 0.04 |
| 7-2-Comparative | COMP CD-4 | 8.9 | 0.212 | 3.66 | 1.68 | 3.22 | 2.45 | 0.11 | 0.07 | 0.04 |

TABLE XI

| Sample | Olefinic Co-Developer | Amount ($\times 10^{-6}$ moles) | Dmin | Dmax | Speed-2 | AC1 | Silver Efficiency Dmax/Ag (Coating Wt.) | Image Tone at D = 1.5 | Image Tone at D = 2.0 | Image Tone at D = 2.5 |
|---|---|---|---|---|---|---|---|---|---|---|
| 8-1-Comparative | COMP CD-1 | 7.6 | 0.209 | 3.75 | 1.68 | 3.27 | 2.52 | −0.02 | −0.10 | −0.19 |
| 8-2-Comparative | COMP CD-1 | 10.2 | 0.209 | 4.03 | 1.81 | 4.46 | 2.67 | −0.06 | −0.14 | −0.24 |
| 8-3 Comparative | COMP CD-2 | 7.6 | 0.212 | 3.77 | 1.66 | 3.51 | 2.50 | −0.02 | −0.10 | −0.18 |
| 8-4 Comparative | COMP CD-2 | 10.2 | 0.211 | 3.97 | 1.79 | 4.37 | 2.66 | −0.06 | −0.14 | −0.23 |

EXAMPLE 9

Inventive & Comparative

This example demonstrates that the use of the olefinic co-developer having a tetra-n-butylphosphonium cation according to this invention provided improved image tone.

The photothermographic emulsion and topcoat formulations were prepared as described in Example 1 except the photothermographic emulsion formulation contained 6.03 parts of Developer I-2 and 1.64 parts of Developer III-1. To 28.46 g of the completed formulation was added each of the comparative and inventive compounds as described in Example 1. The photothermographic emulsion formulation was coated to obtain a coating weight of between about 1.50 and 1.60 g of total silver/m$^2$ (between about 0.0139 and 0.0148 mol/m$^2$). The absorbance in the imaging layer was about 1.30 to 1.35 at 815 nm.

The backside of the support had been coated with an antihalation and antistatic layer having an absorbance greater than 0.3 between 805 and 815 nm, and a resistivity of less than $10^{11}$ ohms/square.

Samples of each photothermographic material were imaged, developed, and equilibrated as described in Example 1.

A strip sample of each photothermographic material was scanned using a computerized densitometer equipped with both a visible filter and a blue filter having peak transmission at about 440 nm. The Dmin, Dmax, Speed-2, AC 1, Silver Efficiency, and Image Tone obtained at dry humidity less than 32% RH and 70° F. (21° C.) using the visible filter are shown below in TABLE XII.

The olefinic co-developer used in Comparative Sample 9-1 (COMP CD-5) had a potassium cation. Comparative Sample 9-2 had the same co-developer and separately added tetra-n-butylphosphonium bromide (COMP CD-5+TBPBr). The inventive olefinic co-developer used in Inventive Sample 9-3 (CDP-6) had a tetra-n-butylphosphonium cation. The molar amount of the co-developer in Inventive Sample of 9-3 was higher than the molar equivalent of the co-developer used in Comparative Sample 9-1 as Inventive Sample 9-3 was less reactive at the same molar equivalence. The molar amount of the inventive olefinic co-developer was comparable to the molar equivalents of the corresponding olefinic co-developer and separately added tetra-n-butylphosphonium compound in Comparative Sample 9-2. The Silver Efficiency and the sensitometry were similar for Comparative Sample 9-1 and Inventive Sample 9-3 as shown below in TABLE XII. Use of the inventive olefinic co-developer provided bluer image tone as evidenced by the larger Image Tone values. The Comparative Sample 9-2 had higher Ag Efficiency and more reactive sensitometry than the Inventive Sample 9-3. The image tone was less blue than that of either Comparative Sample 9-1 or Inventive Sample 9-3 as evidenced by the smaller Image Tone values. The separate addition of the tetra-n-butylphosphonium compound provided no improvement in image tone as compared to Inventive Sample 9-3.

TABLE XII

| Sample | Olefinic Co-Developer & Optional Phosphonium Salt | Amount ($\times 10^{-6}$ moles) | Dmin | Dmax | Speed-2 | AC1 | Silver Efficiency Dmax/Ag (Coating Wt.) | Image Tone at D = 1.5 | Image Tone at D = 2.0 | Image Tone at D = 2.5 |
|---|---|---|---|---|---|---|---|---|---|---|
| 9-1-Comparative | COMP CD-5 | 10.2 | 0.219 | 3.68 | 1.65 | 3.42 | 2.46 | 0.07 | 0.05 | −0.02 |
| 9-2-Comparative | COMP CD-5 + TBPBr | 17.8/17.8 | 0.219 | 4.20 | 1.94 | 7.11 | 2.63 | −0.05 | −0.09 | −0.15 |
| 9-3 Inventive | CDP-6 | 17.8 | 0.129 | 3.76 | 1.68 | 3.59 | 2.46 | 0.06 | 0.04 | 0.01 |

EXAMPLE 10

Inventive & Comparative

This example demonstrates that the use of an olefinic co-developer having a benzyl triphenylphosphonium cation according to this invention provided improved image tone.

The photothermographic emulsion and topcoat formulations were prepared as described in Example 1 except the photothermographic emulsion formulation contained 6.03 parts or Developer I-2 and 1.64 parts of Developer III-1. To 28.46 g of the completed formulation was added each of the comparative and inventive co-developers as described in Example 1. The photothermographic emulsion formulation was coated to obtain a coating weight of between about 1.60 and 1.65 g of total silver/m$^2$ (between about 0.0148 and 0.0153 mol/m$^2$). The absorbance in the imaging layer was about 1.25 to 1.35 at 815 nm.

The backside of the support had been coated with an antihalation and antistatic layer having an absorbance greater than 0.3 between 805 and 815 nm, and a resistivity of less than $10^{11}$ ohms/square.

Samples of each photothermographic material were imaged, developed, and equilibrated as described in Example 1.

A strip sample of each photothermographic material was scanned using a computerized densitometer equipped with both a visible filter and a blue filter having peak transmission at about 440 nm. The $D_{min}$, $D_{max}$, Speed-2, AC 1, Silver Efficiency, and Image Tone obtained at dry humidity less than 32% RH and 70° F. (21° C.) using the visible filter are shown below in TABLE XIII.

The olefinic co-developer used in Comparative Sample 10-1 (COMP CD-10) had a potassium cation. The co-developer used in Inventive Sample 10-2 (CDP-5) had a benzyl triphenylphosphonium cation. The molar amount of the co-developer in Inventive Sample of 10-2 was higher than the molar equivalent of the co-developer in Comparative Sample 10-1 as Inventive Sample 10-2 was less reactive at the same molar equivalence. The Silver Efficiency and the sensitometry were similar for Comparative Sample 10-1 and Inventive Sample 10-2 as shown in TABLE XIII. Use of the inventive olefinic co-developer provided bluer image tone as evidenced by the larger Image Tone values.

TABLE XIII

| Sample | Olefinic Co-Developer | Amount ($\times 10^{-6}$ moles) | Dmin | Dmax | Speed-2 | AC1 | Silver Efficiency Dmax/Ag (Coating Wt.) | Image Tone at D = 1.5 | Image Tone at D = 2.0 | Image Tone at D = 2.5 |
|---|---|---|---|---|---|---|---|---|---|---|
| 10-1-Comparative | COMP CD-10 | 4.8 | 0.220 | 3.97 | 1.92 | 4.40 | 2.45 | 0.19 | 0.17 | 0.15 |
| 10-2-Inventive | CDP-5 | 5.7 | 0.229 | 4.08 | 2.01 | 4.71 | 2.52 | 0.24 | 0.21 | 0.20 |

EXAMPLE 11

Inventive & Comparative

This example demonstrates that the use of an olefinic co-developer with a benzyl triphenylphosphonium cation according to this invention provided improved image tone.

The photothermographic emulsion and topcoat formulations were prepared as described in Example 1 except the photothermographic emulsion formulation contained 6.03 parts of Developer I-2 and 1.64 parts of Developer III-1. To 28.46 g of the completed formulation was added each of the comparative and inventive compounds as described in Example 1. The photothermographic emulsion formulation was coated to obtain a coating weight of between about 1.45 and 1.55 g of total silver/$m^2$ (between about 0.0134 and 0.0143 mol/$m^2$). The absorbance in the imaging layer was about 1.40 to 1.45 at 815 nm.

The backside of the support had been coated with an antihalation and antistatic layer having an absorbance greater than 0.3 between 805 and 815 nm, and a resistivity of less than $10^{11}$ ohms/square.

Samples of each photothermographic material were imaged, developed, and equilibrated as described in Example 1.

A strip sample of each photothermographic material was scanned using a computerized densitometer equipped with both a visible filter and a blue filter having peak transmission at about 440 nm. The $D_{min}$, $D_{max}$, Speed-2, AC 1, Silver Efficiency, and Image Tone obtained at dry humidity less than 32% RH and 70° F. (21° C.) using the visible filter are shown below in TABLE XIV The photothermographic material of Comparative Sample 11-1 contained an olefinic co-developer (COMP CD-10) and the separately added benzyl triphenylphosphonium chloride (BTPPCl). The co-developer used in Inventive Sample 11-2 (CDP-5) had a benzyl triphenylphosphonium cation. The molar amount of the inventive olefinic co-developer was comparable to the molar equivalents of the corresponding co-developer and the added benzyl triphenylphosphonium compound in Comparative Sample 11-1. Comparative Sample 11-1 had similar Ag Efficiency but more reactive sensitometry than Inventive Sample 11-2. The Inventive Sample 11-2 provided an image with bluer image tone than did Comparative Sample 11-1 as evidenced by the larger Image Tone values.

TABLE XIV

| Sample | Olefinic Co-Developer & Additive Phosphonium Salt | Amount ($\times 10^{-6}$ moles) | Dmin | Dmax | Speed-2 | AC1 | Silver Efficiency Dmax/Ag (Coating Wt.) | Image Tone at D = 1.5 | Image Tone at D = 2.0 | Image Tone at D = 2.5 |
|---|---|---|---|---|---|---|---|---|---|---|
| 11-1-Comparative | COMP CD-10 + BTPPC1 | 6.4 | 0.216 | 4.02 | 1.97 | 4.86 | 2.63 | 0.16 | 0.12 | 0.08 |
| 11-2-Inventive | CDP-5 | 6.4 | 0.215 | 3.80 | 1.84 | 3.74 | 2.62 | 0.21 | 0.20 | 0.19 |

EXAMPLE 12

Inventive & Comparative

This example demonstrates that the use of an olefinic co-developer having a hexadecyltri-n-butylphosphonium cation according to this invention provided improved image tone.

The photothermographic emulsion and topcoat formulations were prepared as described in Example 1 except the photothermographic emulsion formulation contained 6.03 parts of Developer I-2 and 1.64 parts of Developer III-1. To 28.46 g of the completed formulation was added the comparative and inventive compounds as described in Example 1. The photothermographic emulsion formulation was coated to obtain a coating weight of between about 1.55 and 1.60 g of total silver/$m^2$ (between about 0.0143 and 0.0148 mol/$m^2$). The absorbance in the imaging layer was about 1.35 to 1.45 at 815 nm.

The backside of the support had been coated with an antihalation and antistatic layer having an absorbance greater than 0.3 between 805 and 815 nm, and a resistivity of less than $10^{11}$ ohms/square.

Samples of each photothermographic material were imaged, developed, and equilibrated as described in Example 1.

A strip sample of each photothermographic material was scanned using a computerized densitometer equipped with both a visible filter and a blue filter having peak transmission at about 440 nm. The $D_{min}$, $D_{max}$, Speed-2, AC 1, Silver Efficiency, and Image Tone obtained at dry humidity less than 32% RH and 70° F. (21° C.) using the visible filter are shown below in TABLE XV.

The olefinic co-developer used in Comparative Sample 12-1 (COMP CD-5) had a potassium cation, while the co-developer used in Inventive Sample 12-2 (CDP-7) had a hexadecyltri-n-butylphosphonium cation. The molar amount of the olefinic co-developer in Inventive Sample of 12-2 was higher than the molar equivalent of the olefinic co-developer in Comparative Sample 12-1 as Inventive Sample 12-2 was less reactive at the same molar equivalence. The Silver Efficiency and the sensitometry were similar for the Comparative Sample 12-1 and Inventive Sample 12-2 as shown in TABLE XV. Use of the inventive co-developer provided bluer image tone as demonstrated by the larger Image Tone values.

TABLE XV

| Sample | Olefinic Co-Developer | Amount ($\times 10^{-6}$ moles) | Dmin | Dmax | Speed-2 | AC1 | Silver Efficiency Dmax/Ag (Coating Wt.) | Image Tone at D = 1.5 | Image Tone at D = 2.0 | Image Tone at D = 2.5 |
|---|---|---|---|---|---|---|---|---|---|---|
| 12-1-Comparative | COMP CD-5 | 10.2 | 0.217 | 3.98 | 1.77 | 3.81 | 2.48 | 0.18 | 0.16 | 0.12 |
| 12-2-Inventive | CDP-7 | 15.2 | 0.217 | 3.84 | 1.75 | 4.43 | 2.46 | 0.23 | 0.20 | 0.15 |

EXAMPLE 13

Inventive & Comparative

This example demonstrates that the use of an olefinic co-developer having a benzyl triphenylphosphonium cation according to this invention provided improved image tone.

The photothermographic emulsion and topcoat formulations were prepared as described in Example 1 except the photothermographic emulsion formulation contained 6.03 parts of Developer I-2 and 1.64 parts of Developer III-1. To 28.46 g of the completed formulation was added each of the comparative and inventive compounds as described in Example 1. The photothermographic emulsion formulation was coated to obtain a coating weight of between about 1.50 and 1.60 g of total silver/$m^2$ (between about 0.0139 and 0.0148 mol/$m^2$). The absorbance in the imaging layer was about 1.40 to 1.47 at 815 nm.

The backside of the support had been coated with an antihalation and antistatic layer having an absorbance greater than 0.3 between 805 and 815 nm, and a resistivity of less than $10^{11}$ ohms/square.

Samples of each photothermographic material were imaged, developed, and equilibrated as described in Example 1.

A strip sample of each photothermographic material was scanned using a computerized densitometer equipped with both a visible filter and a blue filter having peak transmission at about 440 nm. The $D_{min}$, $D_{max}$, Speed-2, AC 1, Silver Efficiency, and Image Tone obtained at dry humidity less than 32% RH and 70° F. (21° C.) using the visible filter are shown below in TABLE XVI.

The olefinic co-developer used in Comparative Sample 13-1 (COMP CD-1) had a potassium cation while Comparative Sample 13-2 (COMP CD-1+BTPPCl) had the same olefinic co-developer and the separately added benzyl triphenylphosphonium compound. The olefinic co-developer used in Inventive Sample 13-3 (CDP-3) had a benzyl triphenylphosphonium cation. The molar amount of the co-developer in Inventive Sample of 13-3 was the same molar equivalent of the co-developer used in Comparative Sample 13-1. The molar amount of the inventive co-developer was comparable to the molar equivalents of the corresponding co-developer and separately added benzyl triphenylphosphonium compound in Comparative Sample 13-2. The Silver Efficiency and the sensitometry were similar for Comparative Sample 13-1 and Inventive Sample 13-3 as shown in TABLE XVI. Use of the inventive co-developer provided bluer image tone as demonstrated by the larger Image Tone values. Comparative Sample 13-2 provided less Ag Efficiency and similar sensitometry as Inventive Sample 13-3. The image tone was less blue than in Inventive Sample 13-3 as evidenced by the smaller Image Tone values. The separate addition of the benzyl triphenylphosphonium compound provided a smaller improvement in image tone as compared to use of the inventive olefinic co-developer in Inventive Sample 13-3.

The invention has been described in detail with particular reference to certain preferred embodiments thereof, but it will be understood that variations and modifications can be effected within the spirit and scope of the invention.

TABLE XVI

| Sample | Olefinic Co-Developer & Additive Phosphonium Salt | Amount ($\times 10^{-6}$ moles) | Dmin | Dmax | Speed-2 | AC1 | Silver Efficiency Dmax/Ag (Coating Wt.) | Image Tone at D = 1.5 | Image Tone at D = 2.0 | Image Tone at D = 2.5 |
|---|---|---|---|---|---|---|---|---|---|---|
| 13-1-Comparative | COMP CD-1 | 10.2 | 0.219 | 4.09 | 1.85 | 5.17 | 2.60 | 0.13 | 0.06 | −0.01 |
| 13-2-Comparative | COMP CD-1 + BTPPC1 | 10.2/10.2 | 0.218 | 4.09 | 1.84 | 4.77 | 2.59 | 0.11 | 0.06 | 0.00 |
| 13-3 Inventive | CDP-3 | 10.2 | 0.217 | 4.01 | 1.92 | 4.88 | 2.65 | 0.18 | 0.11 | 0.04 |

The invention claimed is:

1. A photothermographic material comprising a support having on at least one side thereof, one or more photothermographic imaging layers comprising in reactive association:

a. a photosensitive silver halide, b. a non-photosensitive source of reducible silver ions, c. a reducing agent composition for said reducible silver ions comprising a trisphenol reducing agent represented by the following Structure (I), d. a polymeric binder, and e. a substituted olefinic co-developer that is represented by the following Structure (IV):

Structure (I)

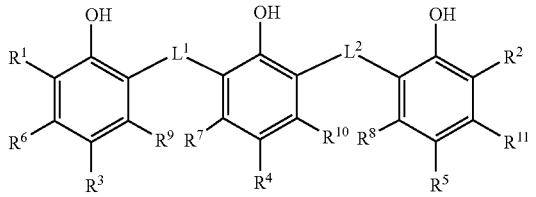

wherein $L^1$ and $L^2$ are independently sulfur or a mono-substituted or unsubstituted methylene group, $R^1$ and $R^2$ are independently primary or secondary substituted or unsubstituted alkyl groups having 1 to 12 carbon atoms, $R^3$, $R^4$, and $R^5$ are independently substituted or unsubstituted alkyl groups having 1 to 12 carbon atoms, substituted or unsubstituted alkoxy groups having 1 to 12 carbon atoms, or halo groups, and $R^6$, $R^7$, $R^8$, $R^9$, $R^{10}$, and $R^{11}$ are independently hydrogen or any substituent that is substitutable on a benzene ring, (IV)

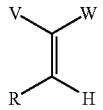

wherein V and W are independently aromatic or electron withdrawing groups, provided that at least one of V and W is an electron withdrawing group, or V and W can represent the atoms necessary to form a ring containing an electron withdrawing group, R is an $—O^-A^+$ or $—S^-A^+$ group, and $A^+$ is a quaternary phosphonium cation.

2. The photothermographic material of claim 1 wherein $L^1$ and $L^2$ are independently a methylene group or a mono-substituted methylene group, $R^1$ and $R^2$ are independently substituted or unsubstituted primary or secondary alkyl groups having 1 to 8 carbon atoms, $R^3$, $R^4$, and $R^5$ are independently substituted or unsubstituted alkyl groups having 1 to 6 carbon atoms, and $R^6$, $R^7$, $R^8$, $R^9$, $R^{10}$, and $R^{11}$ are independently hydrogen, or substituted or unsubstituted methyl, ethyl, or methoxy groups, or chloro groups.

3. The photothermographic material of claim 1 wherein $L^1$ and $L^2$ are unsubstituted methylene groups, $R^1$ and $R^2$ are the same substituted or unsubstituted primary or secondary alkyl groups, $R^3$, $R^4$, and $R^5$ are the same substituted or unsubstituted methyl or ethyl groups, and $R^6$, $R^7$, $R^8$, $R^9$, $R^{10}$, and $R^{11}$ are independently hydrogen or unsubstituted methyl groups.

4. The photothermographic material of claim 1 wherein said reducing agent of Structure (I) is present in an amount of at least 0.5 mmol/$m^2$.

5. The photothermographic material of claim 1 wherein said substituted olefinic co-developer is present at a molar ratio to said reducing agent of Structure (I) of from about 0.001:1 to about 0.02:1.

6. The photothermographic material of claim 1 wherein V is a carboalkoxy group having 2 to 20 carbon atoms, a carboxamido group having 2 to 20 carbon atoms, or a carbocyclic or heterocyclic aryl group having 6 to 10 atoms in the ring, W is a cyano group, and R is an $—O^-A^+$ group.

7. The photothermographic material of claim 1 wherein said quaternary phosphonium cation $A^+$ is represented by either of the following Structures (V) and (VI):

(V)

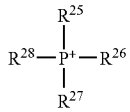

(VI)

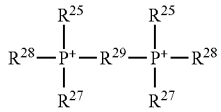

wherein $R^{25}$ through $R^{28}$ are independently alkyl or aryl groups, and $R^{29}$ is an alkylene or arylene group.

8. The photothermographic material of claim 7 wherein $R^{25}$ through $R^{28}$ are each the same or different phenyl groups, or at least one of $R^{25}$ through $R^{28}$ is a benzyl group and the rest are the same or different phenyl groups, $R^{29}$ is an alkylene group having 1 to 10 carbon atoms in the chain or a 1,2-, 1,3-, or 1,4-substituted phenyl group.

9. The photothermographic material of claim 1 wherein V is a carboalkoxy group having 2 to 9 carbon atoms, a carboxamido group having 2 to 7 carbon atoms, or a halogen-substituted phenyl group, and $A^+$ is a tetraphenylphosphonium or benzyltriphenylphosphonium ion.

10. The photothermographic material of claim 1 comprising one or more of the following substituted olefinic co-developers CDP-1, CDP-3, CDP-4, CDP-5, CDP-11, and CDP-12:

CDP-1

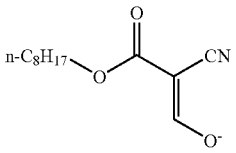

$P^+$(n-butyl)$_4$

CDP-3

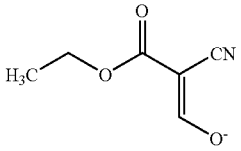

$P^+$(phenyl)$_3$(benzyl)

CDP-4

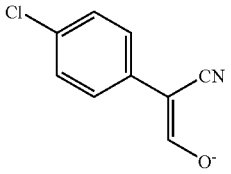

$P^+$(n-butyl)$_4$

CDP-5

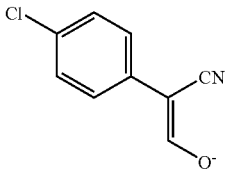

$P^+$(phenyl)$_3$(benzyl)

CDP-11

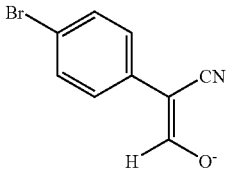

$P^+$(phenyl)$_3$(benzyl)

CDP-12

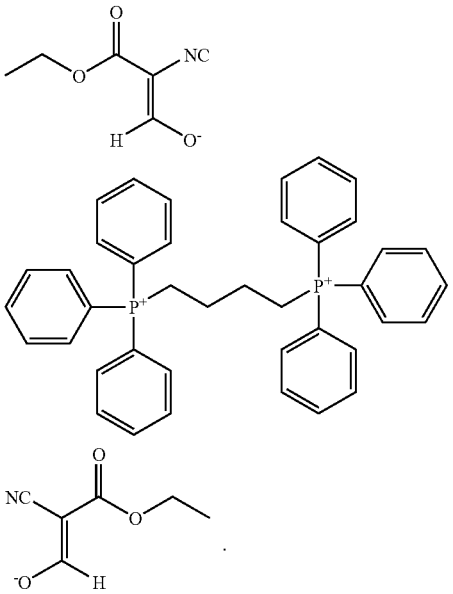

11. The photothermographic material of claim 1 wherein the total amount of silver is from about 1 to about 2.6 g/m$^2$.

12. The photothermographic material of claim 1 further comprising at least one additional reducing agent that is a monophenol or a bisphenol, or both.

13. The photothermographic material of claim 1 further comprising a protective overcoat layer disposed over said photothermographic layer, and interlayer, carrier layer, or any combination thereof.

14. The photothermographic material of claim 1 that provides a silver black-and-white image.

15. The photothermographic material of claim 1 wherein said photothermographic imaging layer has been coated out of an organic solvent and said polymeric binder is a hydrophobic binder that is soluble in said organic solvent.

16. The photothermographic material of claim 1 wherein said photosensitive silver halide is silver bromide or a silver iodobromide that is present predominantly in cubic or tabular grains, said non-photosensitive source of reducible silver ions comprises at least silver behenate, said polymeric binder is a polyvinyl butyral or polyvinyl acetal binder, and said substituted olefinic co-developer is one or more of CDP-1, CDP-3, CDP-4, CDP-5, CDP-11, and CDP-12 shown below, said trisphenol reducing agent is Compound I-2 or I-3 as represented by Structure I in which $R_1$-$R_5$, $L^1$, and $L^2$ are as shown below and is present in an amount of from about 1 to about 5 mmol/m$^2$, said substituted olefinic co-developer is present in an amount of from about 0.005 to about 0.02 mmol/m$^2$, and the molar ratio of said substituted olefinic co-developer to said trisphenol reducing agent is from about 0.001:1 to about 0.02:1, and the total amount of silver is present in an amount of at least 1 g/m$^2$ and less than or equal to 2.6 g/m$^2$,

CDP-1

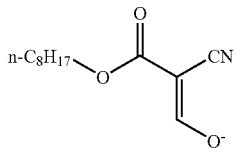

$P^+$(n-butyl)$_4$

CDP-3

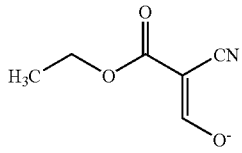

$P^+$(phenyl)$_3$(benzyl)

CDP-4

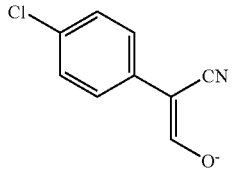

$P^+$(n-butyl)$_4$

CDP-5

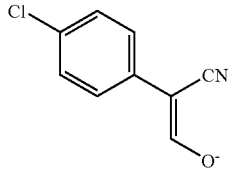

$P^+$(phenyl)$_3$(benzyl)

-continued

CDP-11

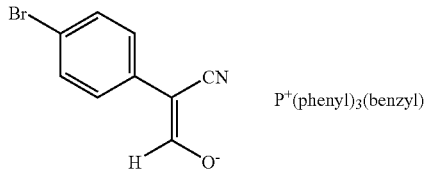

CDP-12

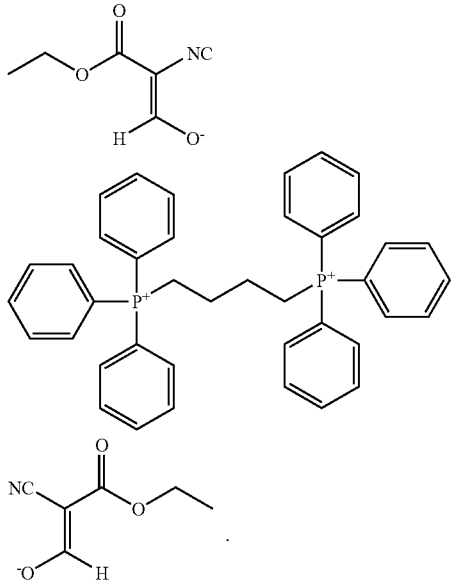

| Trisphenol Reducing Agent | $R_1$, $R_2$ | $R_3$, $R_5$ | $R_4$ | $L^1$, $L^2$ |
|---|---|---|---|---|
| I-2 | $CH_3$ | $CH_3$ | $CH_3$ | $CH_2$ |
| I-3 | Cyclohexyl | $CH_3$ | $CH_3$ | $CH_2$. |

17. The photothermographic material of claim 16 further comprising at least one additional reducing agent that is a bisphenol.

18. A method of forming a visible image comprising:

A) imagewise exposing the photothermographic material of claim 1 to electromagnetic radiation to form a latent image, and B) simultaneously or sequentially, heating said exposed photothermographic material to develop said latent image into a visible image.

19. The method of claim 18 wherein said imagewise exposing is carried out using laser imaging at from about 600 to about 1200 nm or said development is carried out for at least 3 and up to and including 25 seconds, to provide a visible black-and-white image.

20. The method of claim 18 wherein said photothermographic material comprises one or more of the following substituted olefinic co-developers CDP-1, CDP-3, CDP-4, CDP-5, CDP-11, and CDP-12:

CDP-1

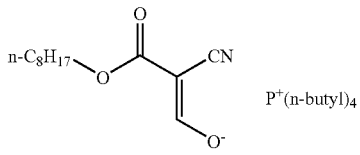

CDP-3

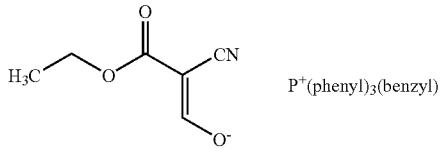

CDP-4

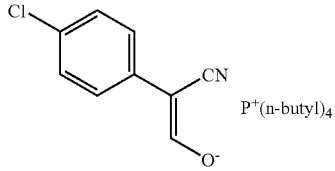

CDP-5

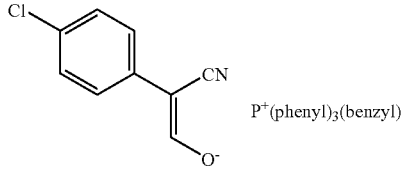

CDP-11

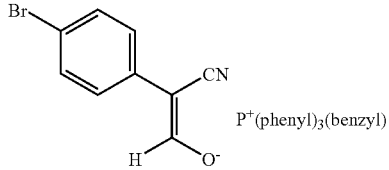

CDP-12

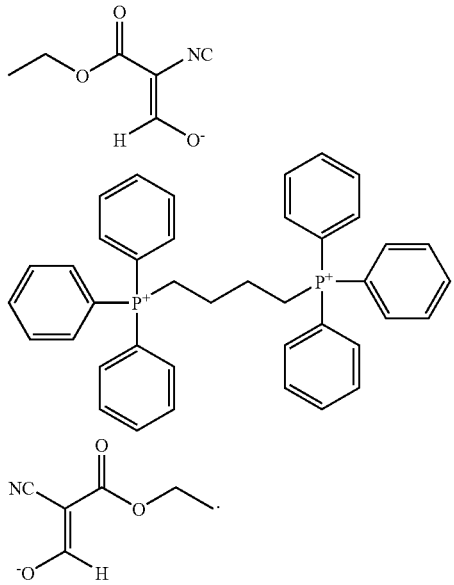

* * * * *